US005250988A

United States Patent [19]

Matsuura et al.

[11] Patent Number: 5,250,988

[45] Date of Patent: Oct. 5, 1993

[54] ELECTROPHOTOGRAPHIC APPARATUS HAVING IMAGE CONTROL MEANS

[75] Inventors: Sadahiro Matsuura, Takatsuki; Osamu Ito, Kadoma; Yasuyuki Shintani, Kobe, all of Japan

[73] Assignee: Matsushita Electric Industrial Co., Ltd., Kadoma, Japan

[21] Appl. No.: 956,953

[22] Filed: Oct. 2, 1992

[30] Foreign Application Priority Data

Oct. 4, 1991 [JP] Japan ..... 3-257406

[51] Int. Cl.[5] ..... G03G 15/00

[52] U.S. Cl. ..... 355/208; 355/214; 355/246

[58] Field of Search ..... 355/208, 219, 214, 216, 355/246

[56] References Cited

U.S. PATENT DOCUMENTS 4,277,162 7/1981 Kasahara et al. ..... 355/208
4,365,894 12/1982 Nakamura ..... 355/246 X
4,967,211 10/1990 Colby et al. ..... 355/214 X

FOREIGN PATENT DOCUMENTS 2-308186 12/1990 Japan .
4-85602 3/1992 Japan .

*Primary Examiner*—Joan H. Pendegrass
*Attorney, Agent, or Firm*—Cushman, Darby & Cushman

[57] ABSTRACT

In an electrophotographic apparatus, densities of toner images of a light reference mark and a dark reference mark are detected by a density sensor, and input voltages such as an illumination power source voltage and an electrostatic charge voltage are varied by small values on the basis of a difference between detected densities and an aimed density, the small values are determined on the basis of a predetermined qualitative model. Subsequently, a line width of the toner image of a reference mark having a striped pattern is detected by a line width sensor and a developer bias voltage is varied by a small value in a similar manner as mentioned above.

10 Claims, 14 Drawing Sheets

ELECTROPHOTOGRAPHIC APPARATUS HAVING IMAGE CONTROL MEANS

FIELD OF THE INVENTION AND RELATED ART STATEMENT

1. FIELD OF THE INVENTION

The present invention relates generally to an electrophotographic apparatus, and more particularly to an electrophotographic copier having image control means for realizing a high-fidelity reproduction of an image of a manuscript.

2. DESCRIPTION OF THE RELATED ART

A particularly important function in an electrophotographic apparatus is to reproduce letters or images of a manuscript to a medium such as a paper with a high fidelity. The degree of fidelity can be represented by differences in density and contrast of the images and in width of lines of letters between the letters or the images of the manuscript and those of a copied document. Namely, when the density and contrast of the letters and images in the copied document are identical with those of the manuscript, and when the width of the lines of the letters in the copied document are identical with those of the manuscript, it is said that the electrophotographic copier has a high fidelity. In general, however, the density and contrast in a document copied by an electrophotographic copier are not identical with those of the manuscript. The density and contrast in the copied document are influenced by fluctuation in an amount of toner in a developing unit and in static electricity voltage of a latent image on a photoconductive dram having a photoconductive substance layer. Moreover, the density and contrast are influenced by changes in room temperature and humidity.

The electrophotographic apparatus comprises steps of charging, exposing, developing and transferring, and the density of the copied image varies with the changes of physical conditions such as an electric potential or a light intensity in these steps. Therefore, the obtained letters and images can be adjusted to have a desired density and a desired contrast by adequately controlling the above-mentioned physical conditions.

An electrophotographic copier having control means of the density is disclosed in the prior art of the U.S. Pat. No. 4,277,162. According to the prior art, two marks which are different from each other in optical density are provided at a non-image area of a platen supporting an original document. These marks serve as a high density reference (hereinafter is referred to as dark reference) and a low density reference (hereinafter is referred to as light reference), respectively. In case of coating black toner on white paper, dark parts designate black parts while the light parts designate white parts. In operation of the electrophotographic copier, optical images of these marks are projected on a photoconductive drum having a photoconductive substance layer through an optical system, and two latent images are formed thereon. The latent images are developed by means of known developing means including toner, and visible toner images are formed. The toner images are transferred onto an endless belt during a rotation of the photoconductive drum.

The densities of the two toner images are detected by two density sensors respectively placed adjacent to the endless belt. The detected values of the two density sensors are compared with predetermined reference values corresponding to respective optimum densities.

If the respective densities of both the toner images are predetermined with adequate values, the densities of the toner images of a background area of the original document (area having no letter and image, white background in general) and a black area (letter and image) correspond to the densities of the low density mark and the high density mark, respectively.

In accordance with the above-mentioned detected values from the two density sensors, when the density of the background area is high and the density of the dark area is insufficient, an amount of toner to the developing unit is increased, for example. In this case, a voltage to be applied to a charger may be increased. On the other hand, when the density of the dark area is sufficient but the density of the background area is excessive, the status is typically caused by an insufficient developing bias voltage. Therefore, the developing bias voltage must be increased. This status may be caused by insufficient light intensity to the original document or deterioration of photoconductive layer on the drum.

High-fidelity reproduction of the width of a line in a letter or an image is also important in the electrophotographic copier. The width of the line of a reproduced letter is influenced by characteristic of an optical system. However, even if the characteristic of the optical system is satisfactory, the width of the line is influenced by other effects such as edge effect or roughness on a surface of a transfer medium, and hence the line of the reproduced letter becomes thinner or becomes thicker than that of the original document. In the above-mentioned prior art, the density and the contrast of the reproduced letter or image are satisfactorily adjusted by controlling the densities of the background area and the dark area in the reproduced images. However, the conventional electrophotographic copier is not provided with any means for line-width high-fidelity reproduction of letters or images.

A prior art directed to line-width high-fidelity reproduction of the letter or the image is shown in the Japanese published unexamined patent application Hei 2-308186. According to this prior art, a latent image of a reference pattern composed of a pair of lines is formed on a photoconductive drum by means of a laser exposing device. The latent image is developed by toner which is supplied by a developer holding member rotating at a constant rotating speed, and a toner image is produced on the photoconductive drum.

The toner image is detected by a reflection-type photosensor composed of a light emitting unit and a light sensing unit. The reflection-type photosensor outputs an output voltage Vp corresponding to a density of the toner image. On the other hand, when the surface of the photoconductive drum having no toner image is detected by the reflection-type photosensor, an output voltage Vc is output therefrom.

Subsequently, the ratio of the output voltages Vp to Vc (Vp/Vc) is calculated. And the difference between the calculated value of the ratio (Vp/Vc) and a relative level corresponding to a predetermined reference width of line is derived. The difference is applied as "correction information" to a driving unit which drives a thin layer regulation member for regulating the amount of toner on the developer holding member. The rotating speed of the thin layer regulation member is varied on the basis of the correction information. Since the developer holding member is rotated with a constant rotating speed, the ratio of the rotating speed of the thin layer regulation member to the rotating speed of the developer holding member is varied by change of the rotating speed of the thin layer regulation member. Consequently, the ratio of the circumferential speed of the thin layer regulation member to the circumferential speed of the developer holding member is varied, and thereby the amount of toner which is attached to the developer holding member is varied.

For example, when the circumferential speed of the thin layer regulation member is increased, the amount of the toner which is supplied to the developer holding member is decreased. Consequently, amount of the toner which adheres to the latent image on the photoconductive drum decreases and the density of the toner image is lowered. When the toner image is transferred to a transfer medium such as a paper, the density of the image on the transfer medium inevitably decreases. The width of the line is also decreased by a phenomenon accompanied with the decrease of the density as is known to one skilled in the art. In the prior art, the ratio (Vp/Vc) is selected so as to realize a desired width of line.

In this prior art, since the width of the line is controlled by varying the amount of toner which is supplied to the photoconductive drum, the density of the reproduced letter or image is inevitably varied responding with the variation of the width of the line. Therefore, the width of the line can not be controlled independently from the density of the reproduced letter or image, and thus, the optimum density in a copy of the original document is not compatible with the high fidelity in the width of the line.

OBJECT AND SUMMARY OF THE INVENTION

An object of the present invention is to provide an electrophotographic apparatus which is capable of copying letters or images of a manuscript with high fidelity.

The electrophotographic apparatus in accordance with the present invention comprises:

a first reference mark of a high density, a second reference mark of a low density and a third reference mark having a plurality of alternatingly arranged high density parts and low density parts, the reference marks being disposed adjacent to a manuscript to be copied, charging means for charging photoconductive substance of the electrophotographic apparatus with a predetermined voltage of static electricity, light emitting means for forming latent image of the static electricity of the first reference mark, second reference mark and third reference mark on the photoconductive substance by applying light emitted from the light emitting means activated by an input voltage, developer means for generating visible image of the latent image on the photoconductive substance by supplying toner which is biased by a predetermined developer bias voltage, density sensor means for detecting density of the visible image of the first and second reference marks formed on the photoconductive substance, line width sensor means for detecting a line width of one of the high density parts and the low density parts of the third reference mark, and control means for controlling the voltage of static electricity for charging the photoconductive substance, the input voltage which is applied to the light emitting means and the developer bias voltage on the basis of outputs of the density sensor and the line width sensor, the control means comprising:

a density control unit including:

input variation vector generating means for generating a plurality of input variation vectors for varying two selected from the voltage of static electricity, the input voltage and the developer bias voltage, qualitative model calculation means for outputting predictive sign data by applying calculation to the input variation vector on the basis of a predetermined qualitative model, error sign detection means for detecting the sign of a difference between an aimed density value and the detected value of the line width sensor means, an input variation vector selection circuit for selecting an input variation vector from the input variation vector generating means on the basis of both the output of the error sign detection means and predictive sign data, and input vector renewal means for adding voltages of the selected input variation vectors to the two selected from the voltage of static electricity, the input voltage and the developer bias voltage, a line width control unit including:

input variation vector generating means for generating a plurality of input variation vectors for varying remaining one of the voltage of static electricity, the input voltage and the developer bias voltage, qualitative model calculation means for outputting predictive sign data by applying calculation to the input variation vector on the basis of a predetermined qualitative model, error sign detection means for detecting the sign of a difference between an aimed line width value and the detected value of the line width sensor means, an input variation vector selection circuit for selecting an input variation vector from the input variation vector generating means on the basis of both the output of the error sign detection means and predictive sign data, input vector renewal means for adding a voltage of the selected input variation vector to the remaining one of the voltage of static electricity, the input voltage and the developer bias voltage, and switching means for alternately activating the density control unit and the line width control unit.

While the novel features of the invention are set forth particularly in the appended claims, the invention, both as to organization and content, will be better understood and appreciated, along with other objects and features thereof, from the following detailed description taken in conjunction with the drawings.

BRIEF DESCRIPTION OF DRAWINGS

FIG. 3(*b*) is a cross-section of a line width sensor in the present invention;

DESCRIPTION OF THE PREFERRED EMBODIMENTS

Figure 1:
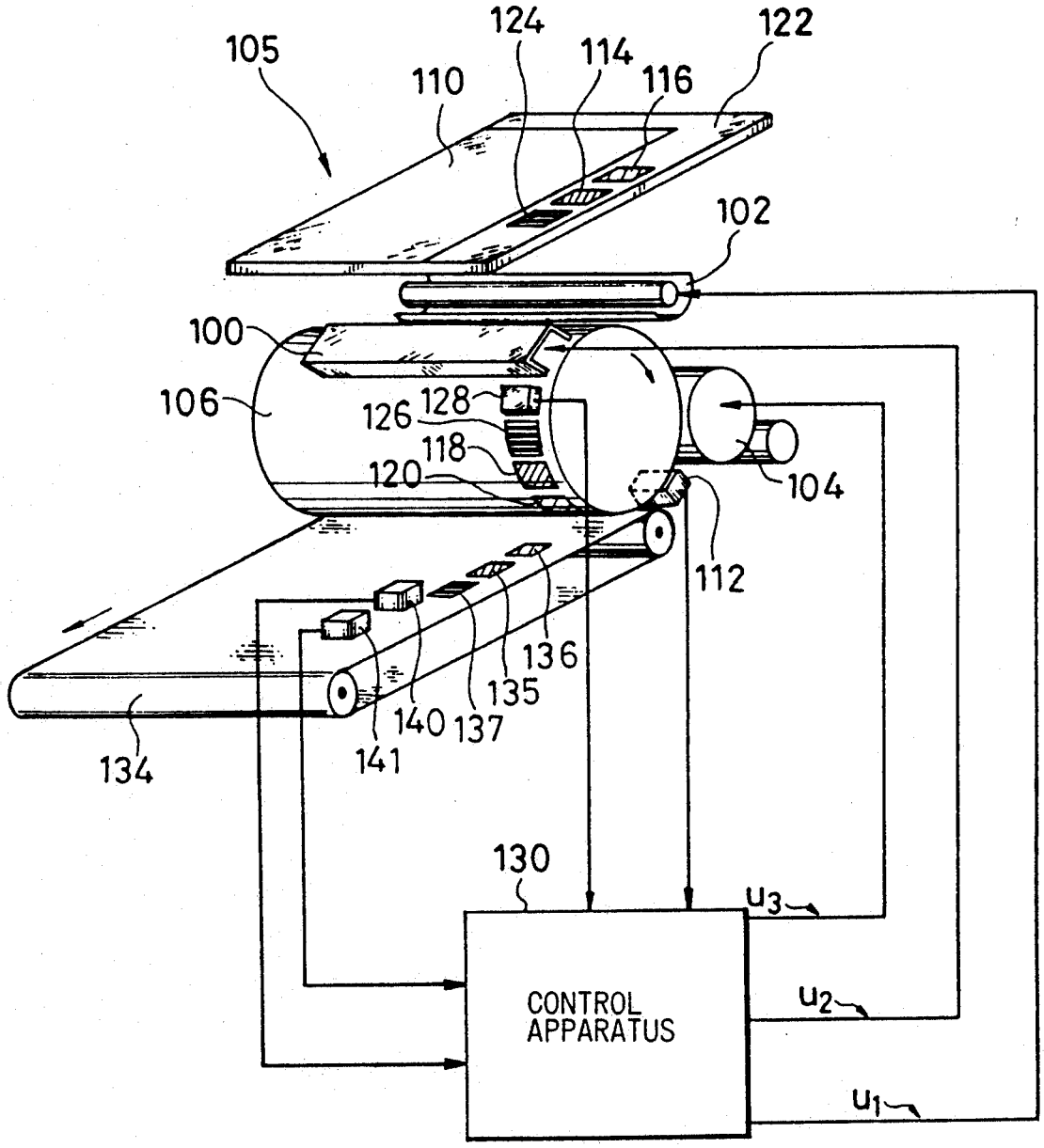
FIG. 1 is a perspective view of a mechanical configuration of an embodiment of the electrophotographic copier in accordance with the present invention.

FIG. 1 is a perspective view of a mechanical configuration of an embodiment of the electrophotographic copier in accordance with the present invention. A manuscript 110 to be copied is placed on a transparent manuscript holder 122 in a manner to face downward and is illuminated by a light source 102 located under the manuscript holder 122. Light reflected by letters or images of the manuscript 110 is focused on the surface of a drum 106 having a photoconductive substance layer through a known optical system (not shown), and the photoconductive substance layer is exposed thereto. Since the photoconductive substance layer of the drum 106 has been charged to a predetermined voltage in advance by a charging unit 100, a latent image of the letter or image is formed by the exposure through the optical system.

Figure 2:
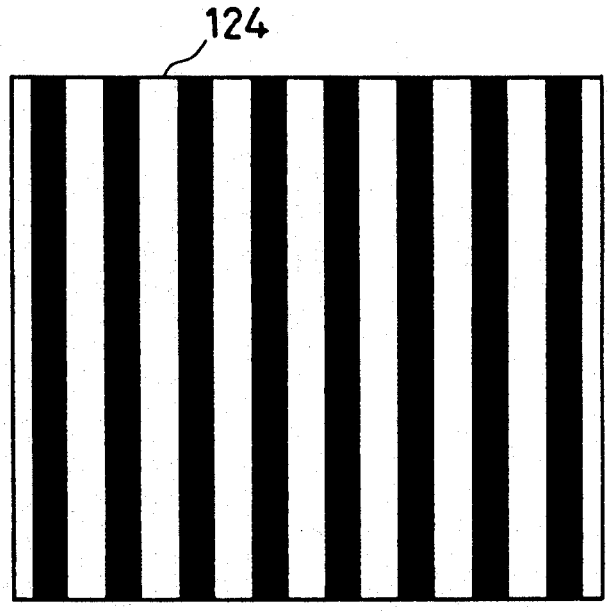
FIG. 2 is a reference pattern of a first example which is used to detect a line width in the electrophotographic copier of the present invention.

A first reference mark 114 of a high density, a second reference mark 116 of a low density and a third reference mark 124 for controlling a "line width" of the letter or image are placed outside the area covered by the manuscript 110 on the manuscript holder 122. The line width is the width of a line forming the letter or the image. The reference mark 124, as shown in FIG. 2, has a striped pattern formed by alternating dark and light stripes of the even width.

A developing unit 104 is located adjacent to the drum 106, and an appropriate amount of toner is supplied to the drum 106 by the developing unit 104 in a manner known in the art. The latent image on the drum 106 is developed by the toner, and a resultant toner image is produced thereon. Referring to FIG. 1, the reference marks 114, 116 and 124 are copied as toner images 118, 120 and 126 on the drum 106, respectively.

A density sensor 112 for detecting the densities of the toner images 118 and 120 and a line width sensor 128 for detecting the line width of the toner image 126 are spaced by a specified gap from and face to the surface of the drum 106. The respective densities of the toner images 118 and 120 are detected by the density sensor 112. An average density of the toner image 126 is detected by the line width sensor 128, and a width of the dark stripes of the toner image 126 is detected as the average density of the stripes as a whole.

A transfer belt 134 is located under the drum 106, and the toner images 118, 120 and 126 formed on the surface of the drum 106 are transferred to the transfer belt as shown by transferred images 135, 136 and 137. The transferred images 135 and 136 are detected by another density sensor 140, and the transferred image 137 is detected by another line width sensor 141.

The outputs of the density sensor 112 and the line width sensor 128 are inputted to a control apparatus 130 which will be elucidated in detail hereinafter. And an input voltage $u_1$ which is applied to the light source 102, a charge voltage $u_2$ which is applied to the charging unit 106 and a developer bias voltage $u_3$ which is applied to the developing unit 104 are generated by the control apparatus 130. The outputs of the density sensor 140 and the line width sensor 141 are also inputted to the control apparatus 130.

Figure 3A:
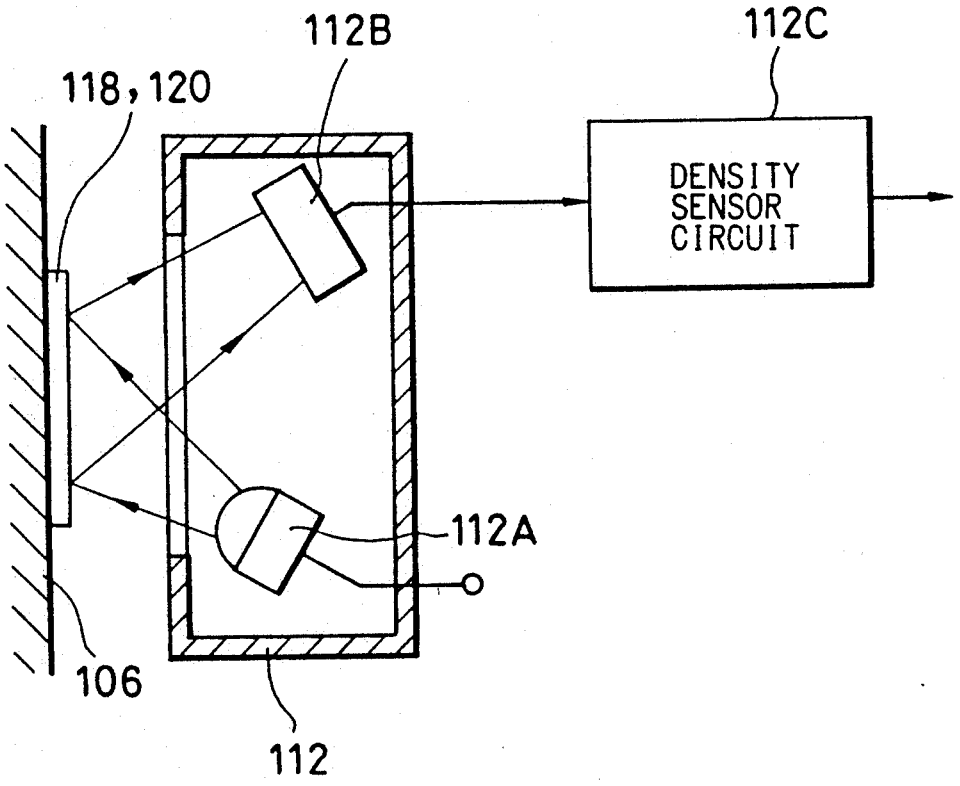
FIG. 3(*a*) is a cross-section of a density sensor in the present invention.
Figure 3B:
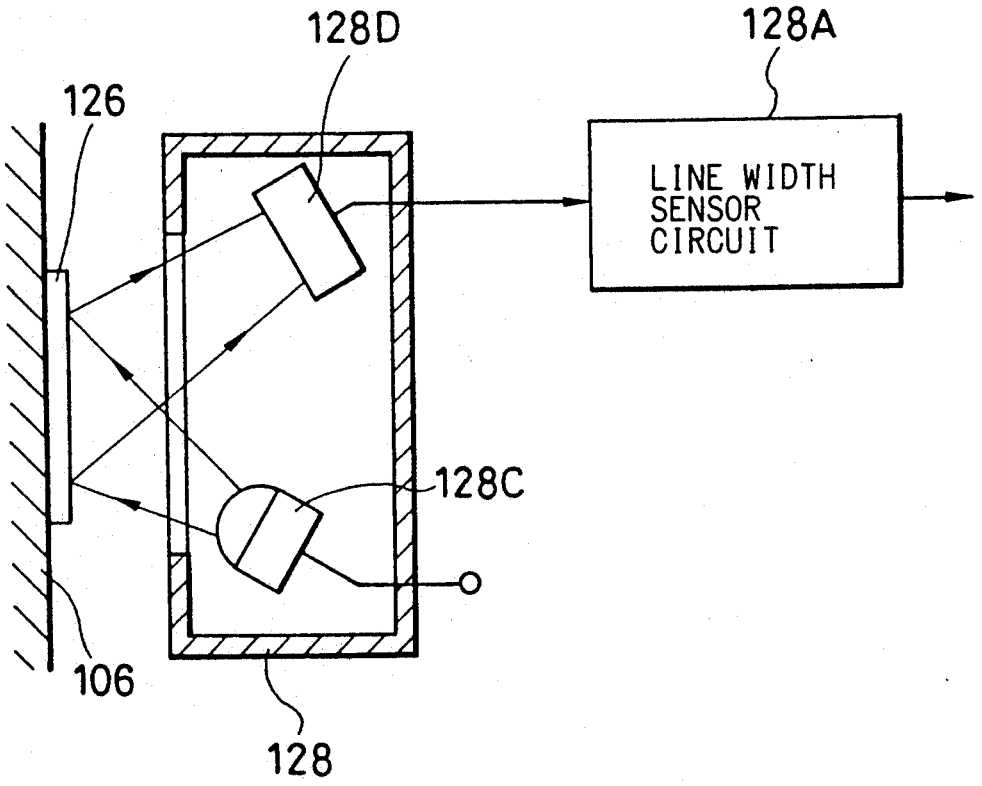

The density sensor 112, for example, comprises a light source 112A and an optical sensor 112B as shown in FIG. 3(*a*). The light source 112A is activated by a voltage-regulated power source (not shown). The light emitted from the light source 112A is applied to the toner image 118 or 120 in response to rotation of the drum 106, and a reflected light from the toner image 118 or 120 is detected by the optical sensor 112B. The optical sensor 112B detects the reflected light from the toner image 118 or 120 when the toner image 118 or 120 have been positioned in the visual field of the light sensor 112B by rotation of the drum 106. The output of the optical sensor 112B is applied to a density sensor circuit 112C of the control apparatus 130.

Configuration of the line width sensor 128 is shown in FIG. 3(*b*). Referring to FIG. 3(*b*), the line width sensor 128 comprises a density sensor, and the density sensor is substantially identical with the density sensor 112 and is composed of a light source 128C and an optical sensor 128D. The light source 128C is activated by a voltage-regulated power source (not shown) and emits a stable intensity. The light from the light source 128C is applied to the toner image 126, and the reflected light is detected by the optical sensor 128D. The optical sensor 128D detects the reflected light from the toner image 126 when the toner image 126 have been positioned in the visual field of the light sensor 128D by rotation of the drum 106. Since the intensity of the light emitted by the light source 128C is constant as mentioned above, the output of the optical sensor 128D varies in proportion to the average density of the toner image 126. The output of the optical sensor 128D is applied to a line width sensor circuit 128A having a multiplier therein.

The toner image 126 is of a striped pattern which is similar to the reference pattern 124 shown in FIG. 2. Therefore, an average intensity of the reflected light from the toner image 126 changes corresponding to variation of a ratio of the width of the dark stripe to the width of the light stripe, and thereby the output of the optical sensor 128D is varied. Since the width of the dark stripe is even with that of the light stripe in the reference mark 124, when the line widths are correctly reproduced in the electrophotographic copier, the width of the dark stripes becomes even with that of the light stripe in the toner image. On the other hand, when the line width is inaccurately reproduced, the width of the dark stripe in the toner image 126 is different from the width of the dark stripe in the reference mark 124 and increases or decreases. Consequently, an average intensity of the reflected light changes, and thereby variation of the line width can be detected.

The output of the optical sensor 128D is multiplied by a predetermined constant value in the line width sensor circuit 128A. The constant value represents a conversion coefficient for converting the average density of the toner image 126 to a line width value.

In general, it is known that the width of the dark stripe in the toner image 126 is not necessarily in proportion to the width of the dark stripe of the reference mark 124, but becomes substantially a constant value in the case where the line width is incorrectly reproduced.

For example, in case where the width of the dark stripe of the toner image 126 increase than that of the reference mark, for instance, when a dark stripe of 3 mm width of the reference mark 124 is reproduced as a dark stripe of 3.1 mm width in the toner image 126, for a dark stripe having 1 mm width in the reference mark 124 the width of the dark stripe toner image 126 becomes 1.1 mm. Therefore, a variation of output level of the density sensor 128 with respect to a variation of the width of the dark stripe of the toner image 126 increases as pitch of the dark stripes and light stripes of the reference mark 124 decrease, and consequently accuracy of detection in the line width sensor 128 is improved. However, miniaturization of the striped pattern of the reference mark 124 is restricted by a resolution of the electrophotographic copier, and hence the pitch of the striped pattern is selected to an adequate value in the range of 20 μm–2 mm. Incidentally, the width of the dark stripe of the reference mark 124 is not necessarily required to be equal to that of the light stripe, and an arbitrary value of the ratio can be selected for the width of the dark stripe to that of the light stripe in the reference mark 124.

Figure 4:
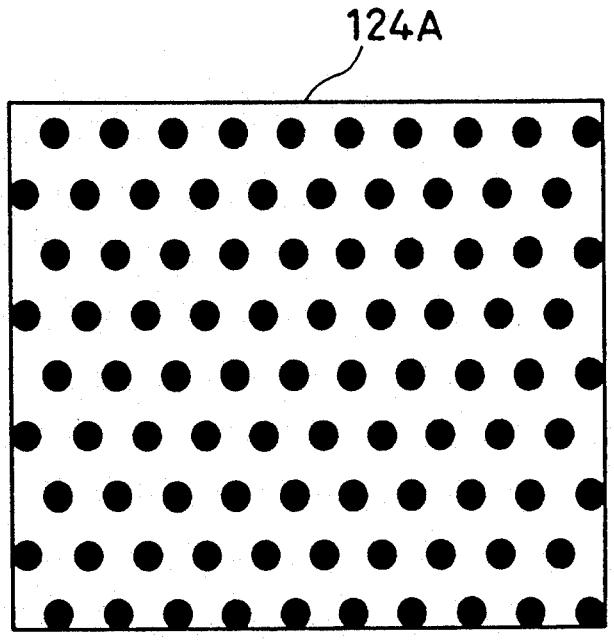
FIG. 4 is a reference pattern of a second example which is used to detect the line width in the electrophotographic copier of the present invention.

Another example of the reference mark for detecting the line width is shown by a reference mark 124A in FIG. 4. The reference mark 124A comprises a plurality of dark dots (in dot pattern). In an electrophotographic copier using the reference mark 124A, data corresponding to a line width can be derived by using the density sensor 128 in a similar manner of the reference mark 124.

Figure 6A:
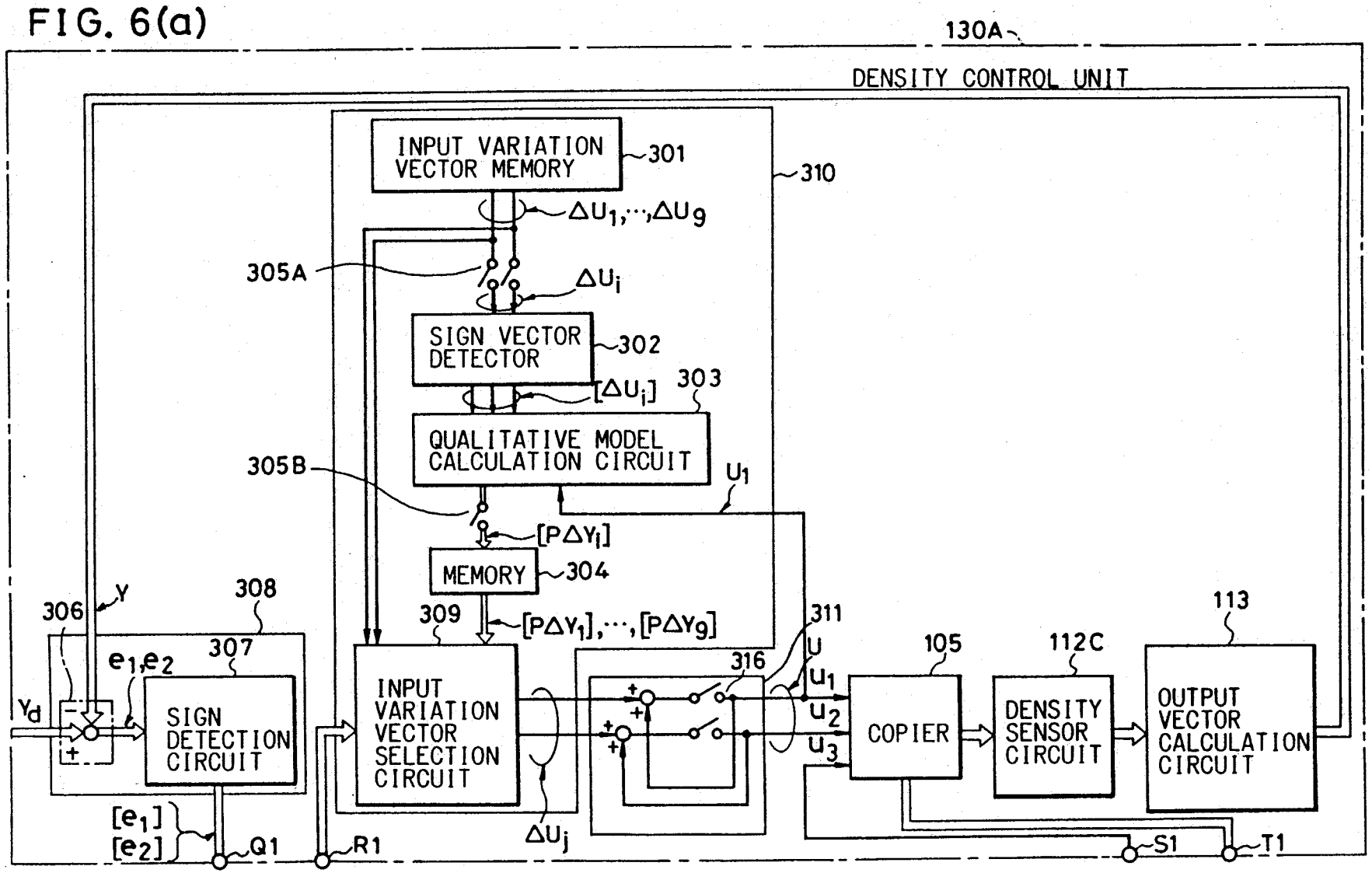
FIGS. 6(*a*) and 6(*b*) in combination show a block diagram of a control apparatus of a first embodiment in accordance with the present invention.
Figure 6B:
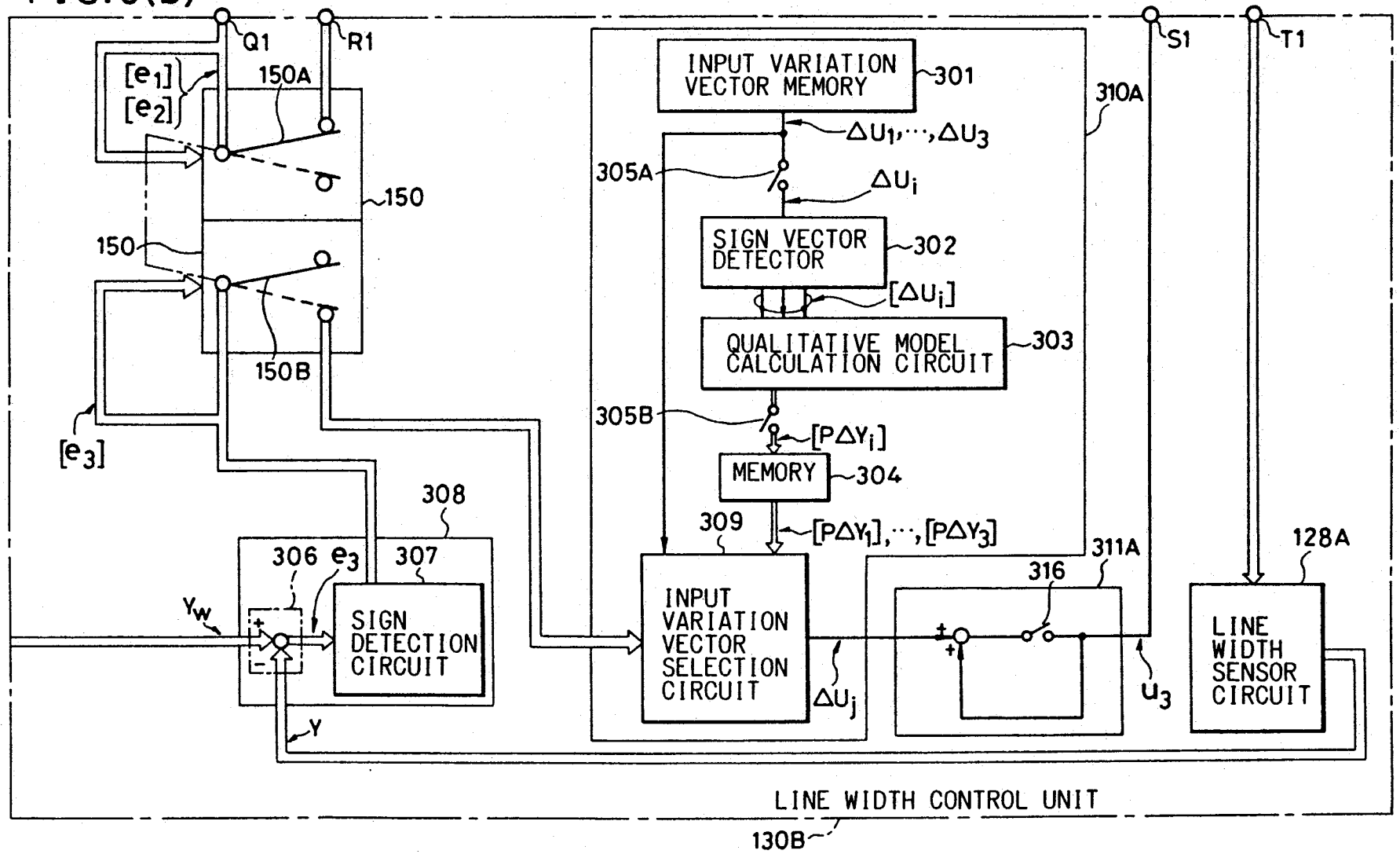

The control apparatus 130 (FIG. 1) of the electrophotographic copier in accordance with the present invention is elucidated hereafter. The control apparatus 130, as shown in FIGS. 6(*a*) and 6(*b*) for example, comprises a density control unit 130A, a line width control unit 130B and a switching unit 150. In control operation, two selected from the input voltage $u_1$, the charge voltage $u_2$ and the developer bias voltage $u_3$ are changed to adjust the density of the toner images 118 and 120, and remaining one is changed to adjust the line width of the toner image 126. In each embodiment which will be elucidated hereafter, the input voltage $u_1$ and the charge voltage $u_2$ are changed to control the density, and the developer bias voltage $u_3$ is changed to control the line width.

The density control unit 130A (FIG. 6(*a*)) receives an output of the density sensor 112 and controls the input voltage $u_1$ and the charge voltage $u_2$, in order to vary the density of a toner images 118 and 120 on the basis of the output of the density sensor 112. The line width control unit 130B (FIG. 6(*a*)) receives the output of the line width sensor 128 and controls the developer bias voltage $u_3$ in order to vary the line width of the toner image on the basis of the output of the line width sensor 128.

The switching unit 150 switches between the connection to the density control unit 130A and the connection to the line width control unit 130B. The density control unit 130A and the line width control unit 130B are alternately activated by switching operation of the switching unit 150.

Operation of the electrophotographic copier having the control apparatus 130 of a first embodiment is elucidated with reference to FIG. 1 and FIGS. 6(*a*) and 6(*b*). Referring to FIGS. 6(*a*) and 6(*b*), terminals Q1, R1, S1 and T1 in FIG. 6(*a*) are connected to terminals Q1, R1, S1 and T1 in FIG. 6(*b*), respectively.

With respect to the first reference mark 114 and second reference mark 116 disposed on the manuscript holder 122, the density of the first reference mark 114 is represented by a high input density "$D_{IN\text{-}H}$" and the density of the second reference mark 116 is represented by a low input density "$D_{IN\text{-}L}$". The density $D_{IN\text{-}H}$ is larger than the density $D_{IN\text{-}L}$. The density sensor 112 disposed under the drum 106 at an end part thereof detects densities of the toner images 118 and 120 formed on the drum 106 by the first and the second reference marks 114 and 116 in the above-mentioned manner. The output of the density sensor 112 is automatically calibrated prior to start of operation in a manner that the density sensor 112 detects the surface of the drum 106 on which no toner is adhered, for example.

In operation of the electrophotographic copier shown in FIG. 1, a "charge voltage $u_2$" is applied to the charging unit 100, and the photoconductive substance on the drum 106 is charged with a static electricity. The illumination light source 102 is activated by an electric power of an "input voltage $u_1$" and illuminates the manuscript 110 and the reference marks 114, 116 and 124. The images of the manuscript 110 and the reference marks 114, 116 and 124 are focused on the drum 106 by an optical system. Consequently, the static electricity on the drum 106 is partially reduced in compliance with the images of the manuscript 110 and the reference marks 114, 116 and 124, and a latent image of an electric potential is formed.

Subsequently, toner is attached to the latent image of the electric potential by the developing unit 104 to which a "developer bias voltage $u_3$" is applied, and the toner images 118, 120 and 126 are formed on the drum 106.

The above-mentioned operation is represented by quantitative relation of equations (1), (2) and (3). (These equations are described in the document of "Imaging Processes and Materials" by J. M. Sturge, published by Van Nostrund Reinhold in 1989, pp. 135–180).

$$\log_{10}(E) = \log_{10}(p_1 \cdot u_1) - D_{IN}, \quad (1)$$

$$V = \{\sqrt{(p_2 \cdot u_2)} - p_3 \cdot E\}^2, \quad (2)$$

$$D_{OUT} = p_4(V - u_3), \quad (3)$$

where, $D_{IN}$: "input density" (high input density $D_{IN\text{-}H}$ of the first reference mark 114 or low input density $D_{IN\text{-}L}$ of the second reference mark 116, for example), $D_{OUT}$: "output density" (high output density $D_{OUT\text{-}H}$ of toner image 118 of the first reference mark 114 or lows output density $D_{OUT\text{-}L}$ of the toner image 120 of the second mark 116 on the drum 106, for example), E: "light energy" dependent on reflected light from first and second reference marks 114 and 116, the light energy corresponds to the input density $D_{IN}$, V: surface potential of the drum 106, the surface potential is reduced by the light energy E, $p_1$: positive parameter dependent on the characteristic of the illumination light source 102, $p_2$: positive parameter dependent on the natural discharge characteristic of the photoconductive substance of the drum 106, $p_3$: positive parameter dependent on transmission factor of the optical system and photo graphic sensitivity of the photoconductive substance, $p_4$: positive parameter dependent on the dielectric constant of the photoconductive substance and density of toner of the developing unit 104.

Figure 5:
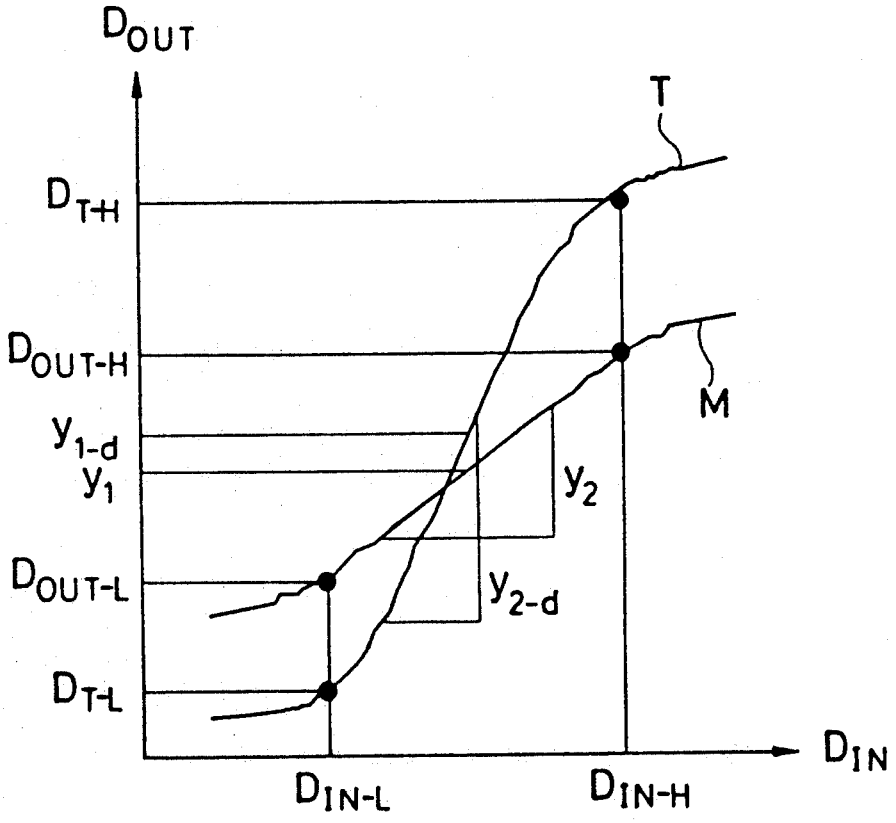
FIG. 5 is a graph of density curves M and T representing density control in the electrophotographic copier of the present invention.

Relation between the input density $D_{IN}$ and the output density $D_{OUT}$ calculated by the equations (1), (2) and (3) are shown by "density curves M and T" in FIG. 5. In FIG. 5, abscissa is graduated by the input density $D_{IN}$, and ordinate is graduated by the output density $D_{OUT}$. The density curve M represents the variation of "measured density" of the toner images 118 and 120, and the density curve T represents the variation of a "target density" thereof. The measured density is represented by a curve connecting between a point ($D_{IN-L}$, $D_{OUT-L}$) and a point ($D_{IN-H}$, $D_{OUT-H}$) which are plotted on the basis of the measured values of the density sensor 112. The target density is represented by a curve connecting between a point ($D_{IN-H}$, $D_{T-L}$) and a point ($D_{IN-H}$, $D_{T-H}$) which are plotted on the basis of a "desirable high density $D_{T-H}$" and a "desirable low density $D_{T-L}$".

The midpoint value $y_1$ of the density curve M is calculated by the below-mentioned relation (4), and the gradient $y_2$ thereof is calculated by the below-mentioned relation (5), $$y_1=(D_{OUT-H}+D_{OUT-L})/2 \quad (4),$$

$$y_2=(D_{OUT-H}-D_{OUT-L})/(D_{IN-H}-D_{IN-L}) \quad (5).$$

Subsequently, elements of an input vector U ($=u_1$, $u_2$, $u_3$) and elements of an output vector Y ($=y_1$, $y_2$) are represented by relations 6A and 6B.

$$y_1=g_1(u_1, u_2, u_3) \quad (6A),$$

$$y_2=g_2(u_1, u_2, u_3) \quad (6B),$$

where, representations $g_1$ and $g_2$ show functions including the positive parameters $p_1$, $p_2$, $p_3$ and $p_4$. If the functions $g_1$ and $g_2$ are accurately obtained, an input vector U is so calculated as that the output vector Y is coincident with a target vector $Y_d$ representing the target density. However, since the parameters $p_1$–$p_4$ depend on various conditions of the electrophotographic process, such as a power source voltage, temperature and humidity, it is very difficult to accurately obtain the functions $g_1$ and $g_2$ including these parameters $p_1$–$p_4$.

In the present invention, a boundary parameter Q including the parameters $p_1$–$p_4$ is defined first. Therefore, the midpoint value $y_1$ of the density curve M is made to be coincident with the midpoint value $y_{1-d}$ of the density curve T, and the gradient $y_2$ of the density curve M is also made to be coincident with the gradient $y_{2-d}$ of the density curve T by adequately controlling the electrophotographic process by using the boundary parameter Q.

The gradient of the density curve M is variable by changing the input voltage $u_1$ and the charge voltage $u_2$. In general, when the input voltage $u_1$ is increased, the density of the toner image is decreased. Then the rate of change of the low output density $D_{OUT-L}$ is larger than that of the high output density $D_{OUT-H}$.

On the other hand, when the charge voltage $u_2$ is increased, the density of the toner image is increased. Then, the rate of change of the low output density $D_{OUT-L}$ is smaller than that of the high output density $D_{OUT-H}$. Consequently, the gradient of the density curve M is adjustable by an adequate combination of an input voltage $u_1$ and a charge voltage $u_2$.

Control apparatus configuration

FIGS. 6(*a*) and 6(*b*) in combination are a circuit block diagram of a first embodiment of the control apparatus by an adaptive control system in accordance with the present invention. FIG. 6(*a*) is a circuit block diagram of the density control unit 130A, for the density control, and FIG. 6(*b*) is a circuit block diagram of the line width control unit 130B for the line width control. The switching circuit 150 is illustrated in FIG. 6(*b*).

Referring to FIG. 6(*a*), the adaptive control system of the first embodiment comprises; and input variation vector determining circuit 310 for determining an input variation vector which adjusts the densities of the toner images 118 and 120; an input vector renewal circuit 311 for renewing the input vector U which is applied to the copier 105 to control the densities of the toner images 118 and 120; an output vector calculation circuit 113; and an error sign detection circuit 308. Output vector Y ($=y_1$, $y_2$) which is output from the output vector calculation circuit 113 is applied to an error sign detection circuit 308.

The input variation vector determination circuit 310 comprises the following seven elements:

(1) input variation vector memory 301:

The input variation vector memory 301 stores predetermined nine input variation vectors $\Delta U_1$–$\Delta U_9$. The number of the input variation vector $\Delta U_i$ is given by ($3^2$). The numeral "3" represents the number of signs "+", "−" and "0", and the exponent "2" of the power is equal to the number of the components of the input variation vector $\Delta U_i$. The input variation vector $\Delta U_i$ comprises two data ($\Delta u_1$, $\Delta u_2$), and each data is either one of a positive value, a negative value or zero, for example ($\Delta u_1$, 0,) or (0, $-u_2$). The positive value represents increase of a voltage and the negative value represents decrease of the voltage. "Zero" represents an unchanged value. The data $\Delta u_1$ and $\Delta u_2$ represent small voltages which are added to the input voltage $u_1$ of the illumination light source 102 and the charge voltage $u_2$ of the charging unite 100, respectively.

(2) Switch 305A:

The switch 305A is closed to input the data of the input variation vector memory 301 to a sign vector detector 302.

(3) Sign vector detector 302:

The sign vector detector 302 receives an input variation vector $\Delta U_i$ from the input variation vector memory 301, and outputs a sign vector [$\Delta U_i$] which represents sign (+, − or 0) of each data. Hereinafter, a letter put in brackets [] represents sign "+", "−" or "0" of the data represented by the letter. For example, when an input variation vector $\Delta U_i$ ($=0$, $-\Delta u_2$) is inputted, a sign vector [$\Delta U_i$] ($=0$, −) is output.

(4) Qualitative model calculation circuit 303:

The qualitative model calculation circuit 303 comprises a calculator for predicting a sign of the output "y" which represents a midpoint value y or a gradient $y_2$ on the basis of the sign vector [$\Delta u_i$] output from the sign vector detector 302. The calculation is performed in compliance with a predetermined qualitative model, and as a result, a predictive sign data [$P\Delta Y_i$] is output.

Hereinafter the "P" located in front of "Δ" represents predictive data of the data represented by the letter. The predictive sign data $[P\Delta Y_i]$ represents a sign for representing a predictive variation direction of the output "y", and comprises one of increase prediction "+", decrease prediction "−", unchanged prediction "0" and impossibility of prediction "?".

(5) Switch 305B:

The switch 305B is connected between the sign vector detector 303 and a memory 304 and is closed to input the output data of the qualitative model calculation circuit 303 to a memory 304.

(6) Memory 304:

The predictive sign data $[P\Delta Y_i]$ output from the qualitative model calculation circuit 303 is memorized in the memory 304 through the switch 305B. In normal operation, twenty-seven predictive sign data $[P\Delta Y_i]$, $[P\Delta Y_i]$-$[P\Delta Y_9]$ are memorized in the memory 304.

(7) input variation vector selection circuit 309:

The input variation vector selection circuit 309 receives a predictive sign data $[P\Delta Y_i]$ from the memory 304 and an input variation vector $\Delta U_i$ from the input variation vector memory 301, then one predictive sign data $[P\Delta Y_j]$ which is coincident with a sign [e] of the value of an error "e" inputted from an error sign detection circuit 308 (which is described hereafter) is selected from entire predictive sign data $[P\Delta Y_1]$-$[P\Delta Y_9]$.

The adaptive control system further comprises the error sign detection circuit 308, an input vector renewal circuit 311.

Error sign detection circuit 308:

The error sign detection circuit 308 has an error calculation circuit 306 for evaluating a difference between an aimed value "$Y_d$" and the detected value "Y" of the density sensor 112, and the error "e" calculated thereby is inputted to a sign detection circuit 307. Then a sign [e] of the value of the error "e" is detected by a sign detection circuit 307, and the sign [e] is inputted to the input variation vector selection circuit 309. The sign [e] has one of data of the signs "+", "−" and "0". Namely, the sign [e] has information to increase or to decrease the output "Y" so as to approach a desired output "$Y_d$", or to maintain the present output.

Input vector renewal circuit 311:

The input variation vector $\Delta U_j$ output from the input variation vector selection circuit 309 is added to the present input U in the input vector renewal circuit 311, and a new input U $(=u_1, u_2)$ is applied to the copier 105. Switches 316 are opened during the above-mentioned addition.

Density sensor 112:

Densities of the toner images 118 and 120 in the copier 105 are detected by the density sensor 112. The output of the density sensor 112 is applied to an output vector calculation circuit 113.

Output vector calculation circuit 113:

Calculations of the relations (4) and (5) are carried out in the output vector calculation circuit 113, and the midpoint value $y_1$ and the gradient $y_2$ are output to the error sign detection circuit 308.

Referring to FIG. 6(*b*), the error sign detection circuit 308 is identical with that in the FIG. 6(*a*). An input variation vector determining circuit 310A and an input vector renewal circuit 311A are identical with the input variation vector determining circuit 310 and the input vector renewal circuit 311 in circuit configuration, respectively. But only the number of data which is operated in the input variation vector determining circuit 310A is different from that of the input variation vector determining circuit 310.

In the input variation vector determining circuit 310A, predetermined three input variation vectors $\Delta U_1$, $\Delta U_2$ and $\Delta U_3$ are stored in the input variation vector memory 301. And one input variation vector $\Delta U_j$ is output from the input variation vector selection circuit 309 and is applied to the input vector renewal circuit 311A. In the input vector renewal circuit 311A, the input $U(=u_3)$ is renewed and is applied to the copier 105.

The output of the line width sensor circuit 128A is applied to the error sign detection circuit 308, Qualitative model The qualitative model is elucidated hereafter.

A qualitative relation between the midpoint value $y_1$ (see relation (4)), the gradient $y_2$ (see relation (5)) and the voltages $u_1$, $u_2$ and $u_3$ are represented by relations 7A and 7B by using functions $g_1$ and $g_2$.

$$\begin{aligned} y_1 &= g_1(u_1, u_2, u_3) \\ &= \frac{p_4}{2}\{(\sqrt{p_2u_2} - p_3 \cdot p_1 \cdot 10^{-DIN-H} \cdot u_1)^2 + (\sqrt{p_2u_2} - p_3 \cdot p_1 \cdot 10^{-DIN-L} \cdot u_1)^2 - 2u_3\}, \end{aligned} \tag{7A}$$

$$\begin{aligned} y_2 &= g_2(u_1, u_2, u_3) \\ &= \frac{p_4}{(D_{IN-H} - D_{IN-L})}\{(\sqrt{p_2u_2} - p_3 \cdot p_1 \cdot 10^{-DIN-H} \cdot u_1)^2 - (\sqrt{p_2u_2} - p_3 \cdot p_1 \cdot 10^{-DIN-L} \cdot u_1)^2\}. \end{aligned} \tag{7B}$$

The midpoint value $y_1$ is partially differentiated by the voltage $u_1$ as shown by equation (8), $$\frac{\partial y_1}{\partial u_1} = -p_1p_3p_4\{\sqrt{V_H} \cdot 10^{-DIN-H} + \sqrt{V_L} \cdot 10^{-DIN-L}\} < 0, \tag{8}$$

where, $V_H$: surface potential at a part of the drum 106 at which the reflected light from the first reference mark 114 is applied, $V_L$: surface potential at a part of the drum 106 at which the reflected light from the second reference mark 116 is applied.

The midpoint value $y_1$ is partially differentiated by the voltage $u_2$ as shown by equation (9), $$\frac{\partial y_1}{\partial u_2} = \frac{\sqrt{p_2} \cdot p_4}{2\sqrt{u_2}}(\sqrt{V_H} + \sqrt{V_L}) > 0. \tag{9}$$

The midpoint value $y_1$ is partially differentiated by the voltage $u_3$ as shown by equation (10), $$\frac{\partial y_1}{\partial u_3} = -p_4 < 0. \tag{10}$$

The gradient $y_2$ is partially differentiated by the voltage $u_1$ as shown by equation (11).

$$\frac{\partial y_2}{\partial u_1} = \frac{2p_1p_3p_4(10^{-DIN-L} - 10^{-DIN-H})}{(D_{IN-H} - D_{IN-L})} \times \{\sqrt{p_2u_2} - p_1p_3u_1(10^{-DIN-H} + 10^{-DIN-L})\}. \quad (11)$$

The term $\{p_2u_2 - p_1p_3u_1(10^{-DIN-H} + 10^{-DIN-L})\}$ of the right side is considered in three cases of positive value (>0), zero (=0) or negative value (<0) as shown by relations (11A), (11B) and (11C), $$\sqrt{p_2u_2} - p_1p_3u_1(10^{-DIN-H} + 10^{-DIN-L}) > 0, \quad (11A)$$

$$\sqrt{p_2u_2} - p_1p_3u_1(10^{-DIN-H} + 10^{-DIN-L}) = 0, \quad (11B)$$

$$\sqrt{p_2u_2} - p_1p_3u_1(10^{-DIN-H} + 10^{-DIN-L}) < 0. \quad (11C)$$

Each relation (11A), (11B) or (11C) is solved with respect to "$u_1$" as shown by the relation (11D), (11E) or (11F), $$\frac{\sqrt{p_2u_2}}{p_1p_3(10^{-DIN-H} + 10^{-DIN-L})} > u_1, \quad (11D)$$

$$\frac{\sqrt{p_2u_2}}{p_1p_3(10^{-DIN-H} + 10^{-DIN-L})} = u_1, \quad (11E)$$

$$\frac{\sqrt{p_2u_2}}{p_1p_3(10^{-DIN-H} + 10^{-DIN-L})} < u_1. \quad (11F)$$

The left sides of the relations (11D), (11E) and (11F) are represented by "Q" which is called a "boundary parameter", as follows:

$$Q = \frac{\sqrt{p_2u_2}}{p_1p_3(10^{-DIN-H} + 10^{-DIN-L})} \quad (11G)$$

Consequently, the voltage $u_1$ is represented by the boundary parameter Q as follows:

$$\left.\begin{array}{l} u_1 > Q \\ u_1 = Q \\ u_1 < Q \end{array}\right\}. \quad (11H)$$

Subsequently, the gradient $y_2$ is partially differentiated by the voltage $u_2$ as shown by equation (12), $$\frac{\partial y_2}{\partial u_2} = \frac{\sqrt{p_2} \cdot p_4}{(D_{IN-H} - D_{IN-L})\sqrt{u_2}}(\sqrt{V_H} - \sqrt{V_L}) > 0. \quad (12)$$

Finally, the gradient $y_2$ is partially differentiated by the voltage $u_3$ as shown by equation (13), $$\frac{\partial y_2}{\partial u_3} = 0. \quad (13)$$

The relation between the predictive sign data $[P\Delta Y] = ([\Delta y_1], [\Delta y_2])$ and input voltage sign data $[\Delta U_j] = ([\Delta u_1], [\Delta u_2], [\Delta u_3])$ is represented by relations (14) and (15), $$[P\Delta y_1] = -[\Delta u_1] + [\Delta u_2] - [\Delta u_3], \quad (14)$$

$$[P\Delta y_2] = \left.\begin{array}{ll} [\Delta u_1] + [\Delta u_2] & (u_1 < Q) \\ [\Delta u_2] & (u_1 = Q) \\ -[\Delta u_1] + [\Delta u_2] & (u_1 > Q) \end{array}\right\}, \quad (15)$$

$[P\Delta y_1]$: predictive sign data of midpoint value $y_1$,
$[P\Delta y_2]$: predictive sign data of gradient $y_2$.

The relations (14) and (15) are shown in Table 1 which represents the predictive sign data in the density control. The region number designates the region of the difference $(u_1 - Q)$.

TABLE 1

| Region number | $[u_1 - Q]$ | Predictive sign data $[P\Delta y] = ([P\Delta y_1], [P\Delta y_2])$ |
|---|---|---|
| 1 | + | $[P\Delta y_1] = -[\Delta u_1] + [\Delta u_2]$<br>$[P\Delta y_2] = -[\Delta u_1] + [\Delta u_2]$ |
| 2 | 0 | $[P\Delta y_1] = -[\Delta u_1] + [\Delta u_2]$<br>$[P\Delta y_2] = [\Delta u_2]$ |
| 3 | − | $[P\Delta y_1] = -[\Delta u_1] + [\Delta u_2]$<br>$[P\Delta y_2] = [\Delta u_1] + [\Delta u_2]$ |

Referring to Table 1, region numbers 1, 2 and 3 show regions which are divided to three parts in compliance with a difference between input vector U $(=u_1, u_2)$ and a boundary parameter Q. A "boundary function sign" in the table 1 is decided as follows: for example, the boundary function sign $[u_1 - Q]$ is positive (+) in the region number 1, because of "$u_1 - Q > 0$". In a similar manner, in the region number 2, the boundary function sign $[u_1 - Q]$ is zero because of "$u_1 - Q = 0$".

Moreover, the predictive sign data $[P\Delta Y]$ is derived as follows: for example, in the region number (1), the predictive signa data $[P\Delta Y_i]$ is represented by a set of two minus signs (−, −) with respect to a sign vector $[\Delta U_i](=(+, 0, -))$. In the region number (2), the predictive sign data $[P\Delta Y_i]$ is represented by a set of two plus signs (+, +) with respect to a sign vector $[\Delta U_i]$ $(=(-, +, -))$.

Consequently, $$\begin{aligned} [P\Delta Y_i] &= (-[\Delta u_1] + [\Delta u_2], [\Delta u_2]) \\ &= (-\text{"}-\text{"} + \text{"}+\text{"}, +). \end{aligned}$$

Moreover, a predictive sign data $[P\Delta Y_i]$ has no conformed value with respect to a sign vector $[\Delta U_i] = (+, +, -)$ as shown by relation (16), $$\begin{aligned} [P\Delta Y_i] &= (-[\Delta u_1] + [\Delta u_2], [\Delta u_2]) \\ &= (-\text{"}+\text{"} + \text{"}+\text{"}, +) = (?, +). \end{aligned} \quad (16)$$

The boundary parameter Q is determined by the parameters $p_1$, $p_2$ and $p_3$ as shown by the relation 11G. However, since measurement of these parameters $p_1$, $p_2$ and $p_3$ is very difficult, the boundary parameter Q cannot be accurately estimated. Therefore the prediction based on Table 1 is not always correct. If the prediction is not correct, a sign data [ΔY] of the actual output detected by the output sign detection circuit 313 is noncoincident with the predictive sign data [PΔY] output from the input variation vector selection circuit 309. In the above-mentioned case, the boundary parameter Q of a qualitative model in the qualitative model calculation circuit 303 is modified, because it seems that the qualitative model which is used in the qualitative model calculation circuit 303 is inadequate.

An example of the operation of modification which is applied with an actual values is described hereafter.

It is assumed that the voltages $u_1$, $u_2$ in an electrophotographic copier are 65 V, 700 V, respectively, and boundary parameter Q is 70 V.

According to Table 1, $$[u_1-Q]=[65-70]=[-5]=\text{"}-\text{"} \quad (17).$$

Accordingly, the region number (3) is selected for use. Then, if the following input variation vector $\Delta U_i$ is applied to the sign vector detector 302:

$$\Delta U_i=(+\Delta u_1, 0)=(+0.5\text{ V}, 0) \quad (18),$$

the predictive sign data [PΔY] is calculated by the Table 1 as follows:

$$\begin{aligned}[P\Delta Y] &= (-[\Delta u_1]+[\Delta u_2], [\Delta u_1]+[\Delta u_2]) \quad (19)\\ &= (-[+0.5]+[0], [+0.5]+[0])\\ &= (-, +).\end{aligned}$$

After operation of the electrophotographic copier to which the above-mentioned input variation vector $\Delta U_i$ is inputted, if the output sign data [ΔY] is "(−,−)", it seems that selection of the region number is wrong. Accordingly, in the Table 1, a region number (1) is selected in a manner that the predictive sign data [PΔY] becomes "(−,−)".

Subsequently, a boundary parameter Q which matches with the boundary function of region number (1) is calculated as follows:

$$[u_1-Q']=[65-Q']=\text{"}+\text{"}>0 \quad (20).$$

In order to fulfill relation (20), the value of "Q'" is selected as follows:

$$Q'=65-\epsilon \quad (21),$$

where, "ε" is a positive real number.

On the other hand, when the sign data [ΔY] is "(−,+)", the predictive sign data [PΔY] is coincident with the sign data [ΔY]. Therefore, boundary parameter Q is not modified. Moreover, in the event that the input voltage $u_1$ is very low in comparison with a boundary parameter Q, namely, that in Table 1, sign $[u_1-Q]$ is "−" (region number (3)), the boundary parameter is not modified.

Table 2 is a qualitative model list of actual sign vectors $[\Delta U_j]$ which are output from the input variation vector determination circuit 310 with respect to the sign [e] of an error "e" detected by the error sign detection circuit 308. In the Table 2, representations "$y_{1-d}$" and "$y_{2-d}$" designate the aimed values of the midpoint value $y_1$ and the gradient $y_2$, respectively.

TABLE 2

| Region number | $[u_1-Q]$ | [e] $[y_{1-d}-y_1]$ | [e] $[y_{2-d}-y_2]$ | $[\Delta U_j]$ |
|---|---|---|---|---|
| 1 | + | + | + | (−, +) |
| | | + | 0 | (−, +) |
| | | + | − | (+, −) |
| | | 0 | + | (−, +) |
| | | 0 | 0 | (0, 0) |
| | | 0 | − | (+, −) |
| | | − | + | (−, +) |
| | | − | 0 | (+, −) |
| | | − | − | (+, −) |
| 2 | 0 | + | + | (−, +) |
| | | + | 0 | (−, 0) |
| | | + | − | (−, 0) |
| | | 0 | + | (0, +) |
| | | 0 | 0 | (0, 0) |
| | | 0 | − | (0, −) |
| | | − | + | (+, 0) |
| | | − | 0 | (+, 0) |
| | | − | − | (+, −) |
| 3 | − | + | + | (0, +) |
| | | + | 0 | (−, +) |
| | | + | − | (−, 0) |
| | | 0 | + | (+, +) |
| | | 0 | 0 | (0, 0) |
| | | 0 | − | (−, −) |
| | | − | + | (+, 0) |
| | | − | 0 | (+, −) |
| | | − | − | (0, −) |

In the Table 2, nine combinations of the input signs [e] and the output sign vectors $[\Delta U_j]$ in each region, which are particularly useful in actual application of the adaptive control to the copier, are selected from twenty-seven combinations in each region. The combinations listed on the table 2 are picked up on the basis of a predetermined software, and hence an efficient adaptive control is realizable.

As elucidated above, a predictive sign data is selected from predetermined qualitative models corresponding to the error between the aimed value "$Y_d$" and the detected value "Y" of the density, and thereby the input voltage $u_1$ and the charge voltage $u_2$ are changed. The above-mentioned operations are repeated until the detected value "Y" of the density converges to the aimed value "$Y_d$".

When the detected value "Y" of the density becomes equal to the aimed value "$Y_d$" by the above-mentioned repetition of operations, both the error signs $[e_1]$ and $[e_2]$ turn to "0" in the high output density $D_{OUT\text{-}H}$ and the low output density $D_{OUT\text{-}L}$, respectively. The data of both the error signs $[e_1]$ and $[e_2]$ are applied to the switching unit 150 in FIG. 6(*b*), and both switching contacts 15A and 15B are moved as shown by dotted lines. Consequently, the operation of the density control unit 130A is interrupted, and the line width control unit 130B shown in FIG. 6(*b*) is activated in turn. Table 3 is a list of qualitative models in the qualitative model calculation circuit 303 in the line width control unit 130B. In the Table 3, the aimed value of the line width is represented by "$Y_{3-d}$".

TABLE 3

| [e] $[y_{3-d}-y_3]$ | $[\Delta u_3]$ |
|---|---|
| + | − |
| 0 | 0 |
| − | + |

After the operation of the line width control unit 130B has started, the developer bias voltage $u_3$ is controlled on the basis of the detected value of the line width sensor 128. The control is performed by varying the developer bias voltage $u_3$ on the basis of the qualitative models shown in the Table 3.

Detailed operation for adjusting the developer bias voltage $u_3$ is elucidated hereafter. A line width $y_3$ in the toner image 126 of the reference mark 124 is represented by the following equation (22):

$$y_3 = L_0 - \sqrt{\frac{1}{p_5}\log\frac{p_1 \cdot p_3 \cdot u_1 \cdot (1 - 10^{-DIN})}{\sqrt{p_2 \cdot u_2} - \sqrt{u_3} - p_1 \cdot p_3 \cdot u_1 \cdot 10^{-DIN}}}, \quad (22)$$

where, "$p_5$" is a positive constant which is decided by defocusing characteristic in an optical system of the electrophotographic copier, "$L_0$" is a positive constant which is decided by the width of the dark stripe of the reference mark 124.

A predictive sign data $[P\Delta y_3]$ of the line width which is derived by the equation (22) is represented by the following equation (23):

$$[P\Delta y_3] = -[\Delta u_1] + [\Delta u_2] - [\Delta u_3] \quad (23).$$

The right side of the equation (23) is identical with that of the equation (14) in the density control.

As seen from the equation (23), elements $[\Delta u_1]$ and $[\Delta u_2]$ of the predictive sign data correlated with adjustment of the density are included in the predictive sign data $[P\Delta y_3]$ of the line width. Consequently, the predictive sign data $[P\Delta y_3]$ is influenced by the input voltage $u_1$ of the light source 102 and the charge voltage $u_2$ of the charging unit 100. Therefore, in the first embodiment, the input voltage $u_1$ and the charge voltage $u_2$ adjusted in the adjustment step of the density are maintained during operation of the line width control unit 130B, and the predictive sign data $[P\Delta y_3]$ is made to depend on only the developer bias voltage $u_3$.

A high output density $D_{OUT\text{-}H}$ and a low output density $D_{OUT\text{-}L}$ are derived by the equations (1), (2) and (3) and are given by equations (24) and (25), respectively, $$D_{OUT-H} = p_4 \cdot \{(\sqrt{p_2 \cdot u_2} - p_1 \cdot p_3 \cdot u_1 \cdot 10^{-DIN-H})^2 - u_3\}, \quad (24)$$

$$D_{OUT-L} = p_4 \cdot \{(\sqrt{p_2 \cdot u_2} - p_1 \cdot p_3 \cdot u_1 \cdot 10^{-DIN-L})^2 - u_3\}. \quad (25)$$

Figure 10:
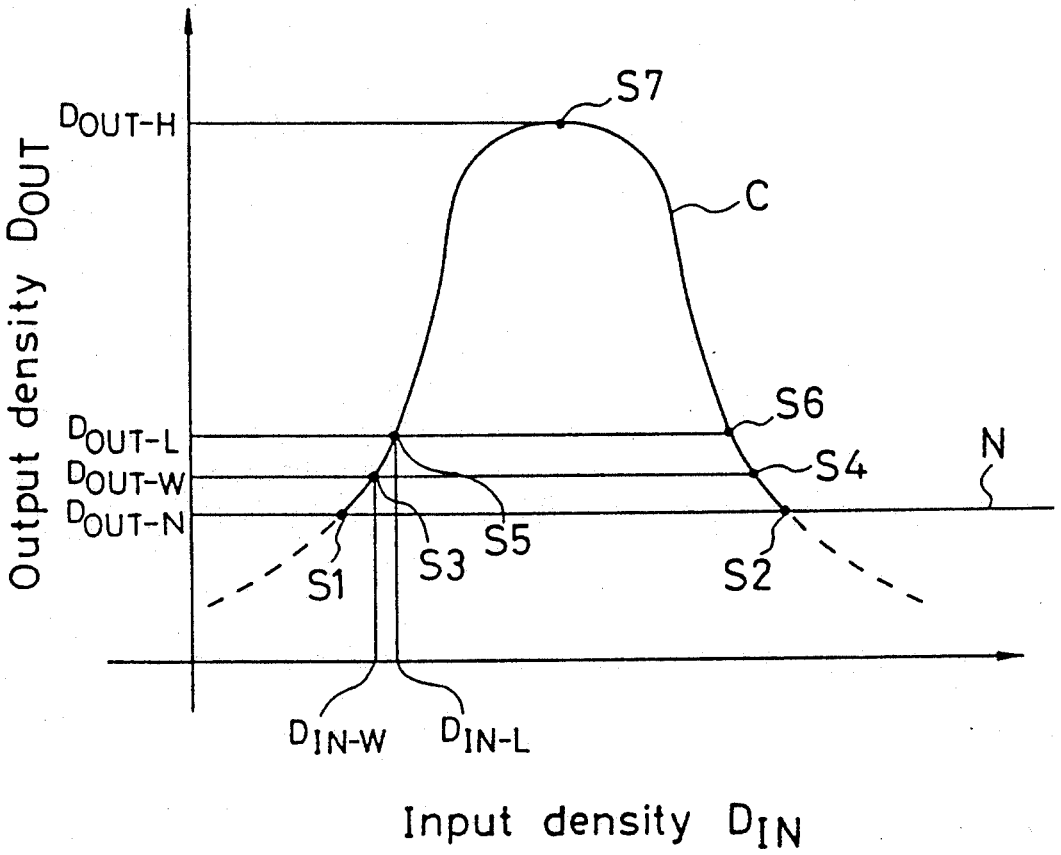
FIG. 10 is a diagram of a density curve representing a toner image of a line.

On the other hand, distribution of the density of a line in the toner image is shown by a density curve C in FIG. 10. Referring to FIG. 10, abscissa designates an input density $D_{IN}$ and ordinate designates an output density $D_{OUT}$. A point S7 designates the position of the high output density $D_{OUT\text{-}H}$, and a point S5 designates the position of the low output density $D_{OUT\text{-}L}$ on the density curve C. A horizontal line N designates the minimum output density $D_{OUT\text{-}N}$ which is determined by the developer bias voltage $u_3$. And intersection points S1 and S2 of the horizontal line H and the curve C designate both edges of the line in the toner image. When an arbitrary point S3 which is of lower density than the low output density $D_{OUT\text{-}L}$ is defined on the curve C and the input density at the point S3 is represented by a "width input density $D_{IN\text{-}W}$", a resultant output density is represented by a "width output density $D_{OUT\text{-}W}$" on the ordinate.

On the above-mentioned density curve C, in the case that a difference between the low output density $D_{OUT\text{-}L}$ and the width output density $D_{OUT\text{-}W}$ ($D_{OUT\text{-}L} - D_{OUT\text{-}W}$) is relatively small, the gradient of the density curve C is gentle in the proximity of the point S3, and the variation of the line width is large. On the contrary, in the case that the above-mentioned difference ($D_{OUT\text{-}L} - D_{OUT\text{-}W}$) is larger, the gradient is steep, and the variation of the line width is small. The predictive sign data $[P\Delta y_3]$ of the line width in the above-mentioned case is represented by the following equation (26):

$$[P\Delta y_3] = -[\Delta(D_{OUT\text{-}L} - D_{OUT\text{-}W})] \quad (26).$$

The width output density $D_{OUT\text{-}W}$ in the equation (26) is represented by the equation (27) by using the equations (1), (2) and (3), $$D_{OUT-W} = p_4 \cdot \{(\sqrt{p_2 \cdot u_2} - p_1 \cdot p_3 \cdot u_1 \cdot 10^{-DIN-W})^2 - u_3\}. \quad (27)$$

Subsequently, the above-mentioned difference ($D_{OUT\text{-}L} - D_{OUT\text{-}W}$) is represented by using the equations (25) and (27), and the letters $u_1$ and $u_2$ are eliminated by using the equation (24). Consequently, the predictive sign data $[P\Delta y_3]$ of the line width including only the developer bias voltage $u_3$ is derived as shown by the following equation (28):

$$[P\Delta y_3] = -[\Delta u_3] \quad (28).$$

The sign of the data $\Delta u_3$ in the right side is negative as shown in the equation (28). Since the sign of the data $\Delta u_3$ in the equation (23) is also negative, the sign of the data $\Delta u_3$ is negative in both the equations (23) and (28). This result-indicates that varying trend of the line width in the density adjustment step is coincident with varying trend of the line width in the line width adjustment step, and has a major advantage in the adjustment operations of the density and the line width as will be elucidated hereafter.

In general, a value having a predetermined allowable range is set for the aimed value of the density or the line width. For example, in the case that an aimed value having the predetermined allowable range is set in the density adjustment operation, first, the density is adjusted to the aimed value in the density control unit 130A. Subsequently, in the operation of the line width control unit 130B, when the detected line width is larger than the aimed value of the line width for example, the developer bias voltage $u_3$ is increased to decrease the line width. Consequently, the line width decreases and the density is also lowered. After the adjustment of the line width, if the density which have been decreased in the line width adjustment step is within the allowable range of the aimed value, it is not necessary that the adjustment of the density is again performed in the density control unit 130A. And thus the adjustment operation can be completed. Consequently, the number of alternating density adjustment operation and line width adjustment operation is reduced, and a time length required to reach both the aimed values can be decreased.

In the embodiments of the present invention, since the input voltage $u_1$ and the charge voltage $u_2$ are changed to adjust the density and the developer bias voltage $u_3$ is changed to adjust the line width, the sign of the data $\Delta u_3$ is negative in both the equations (23) and (28). In the event that the input voltage $u_1$ and the developer bias voltage $u_3$ are changed to adjust the density and further the charge voltage $u_2$ is changed to adjust the line width, the respective signs of the data $\Delta u_2$ in the equation (23) and an equation which is derived with respect to the charge voltage $u_2$ (not shown) do not maintain a constant relation therebetween. Therefore, complicated qualitative models are required and is inadequate to the electrophotographic copier in accordance with the present invention.

On the other hand, in the event that the charge voltage $u_2$ and the developer bias voltage $u_3$ are changed to adjust the density and further the input voltage $u_1$ is changed to adjust line width, the respective signs of the respective data $\Delta u_1$ in the equation (23) and an equation which is derived with respect to the input voltage $u_1$ (not shown) are in reverse with each other. Consequently, the variation trend of the line width in the density adjustment step is in reverse to the variation trend of the line width in the line width adjustment step, and thus the number of adjustment operation to reach both the aimed values is liable to increase.

In the first embodiment as mentioned above, the density and the line width can be finally adjusted to the respective aimed values by repeating alternately the adjustment of the density and the adjustment of the line width.

Figure 7A:
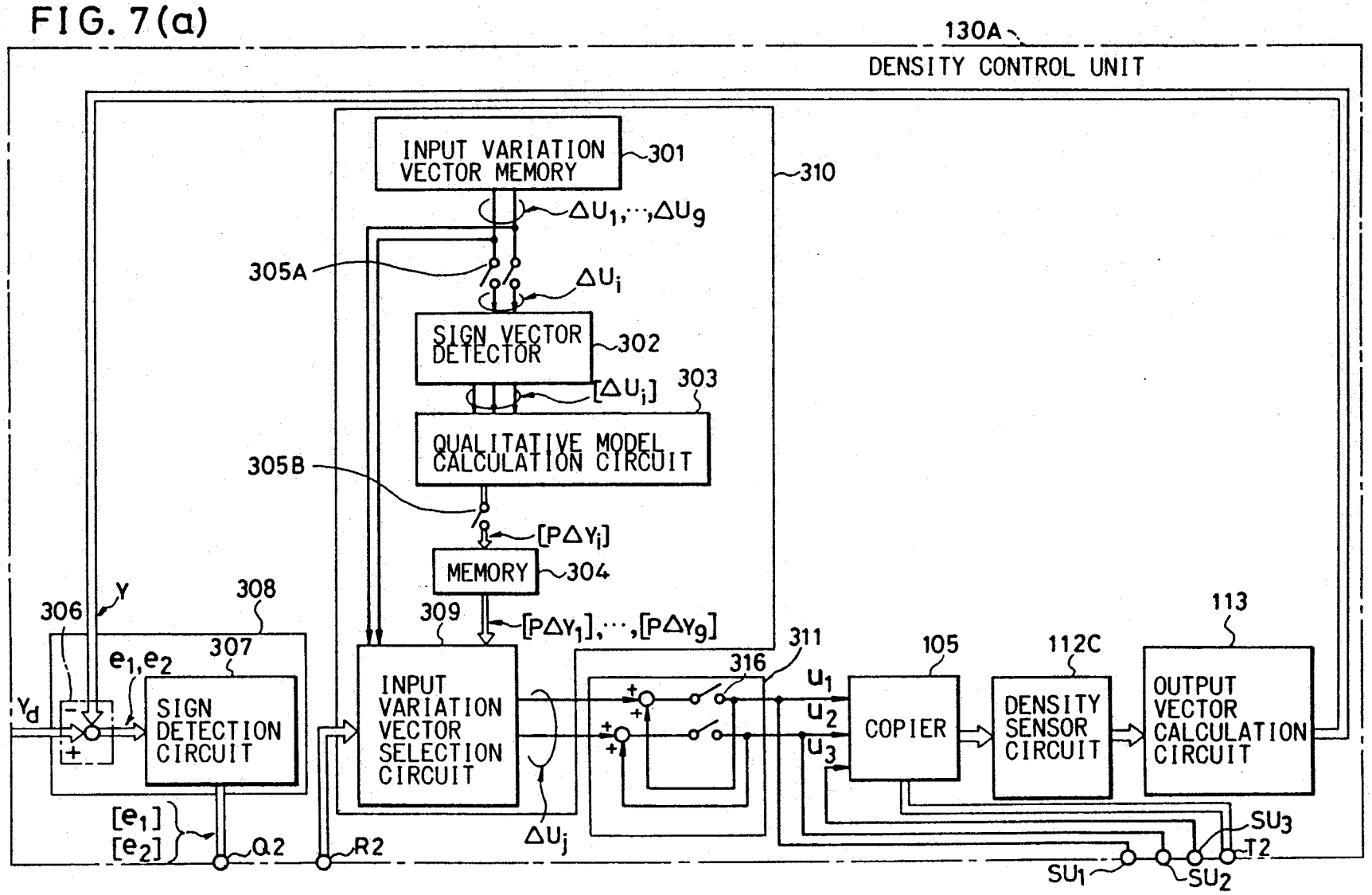
FIGS. 7(*a*) and 7(*b*) in combination show a block diagram of a control apparatus of a second embodiment in accordance with the present invention.
Figure 7B:
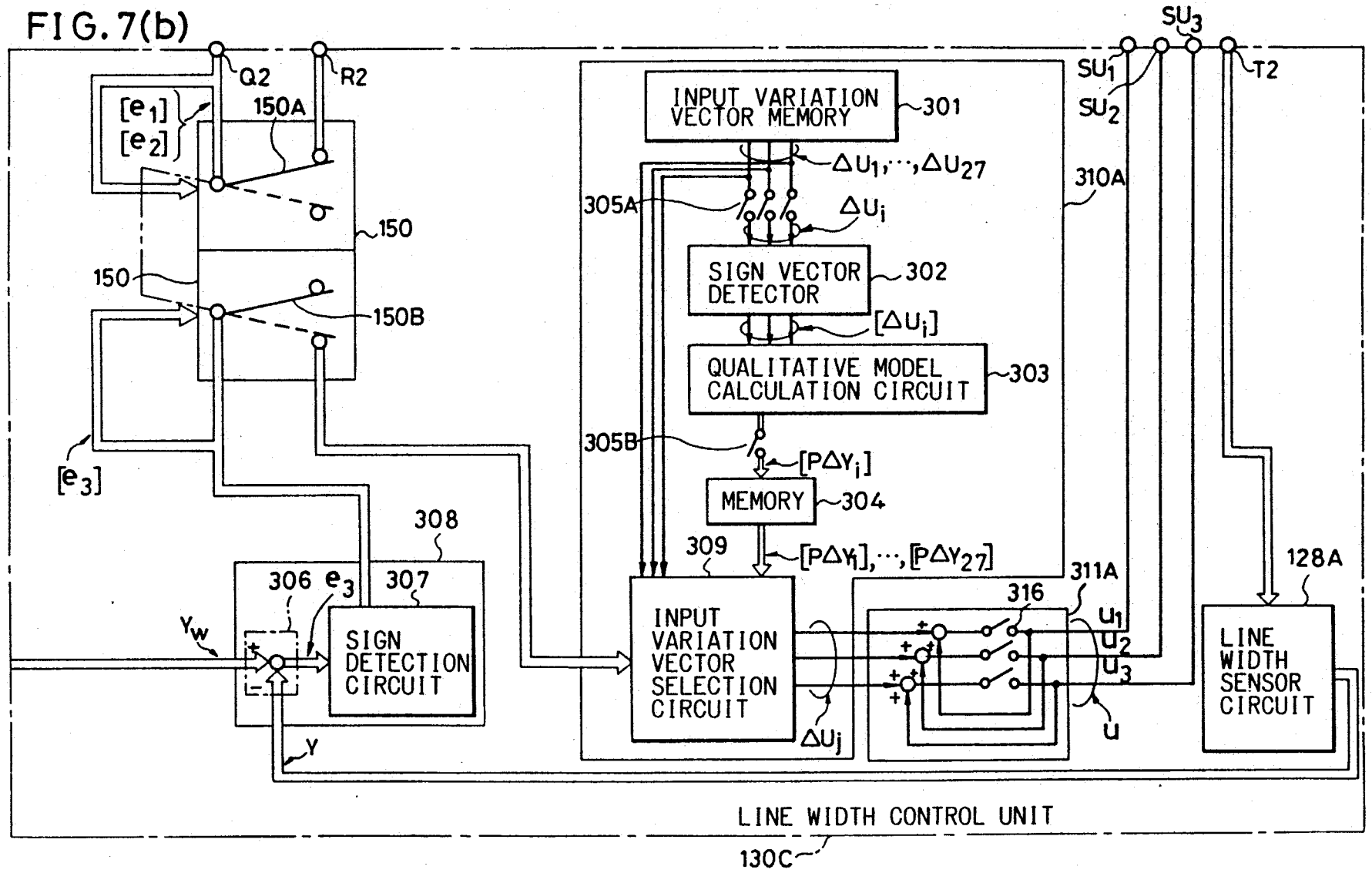

FIGS. 7(*a*) and 7(*b*) in combination show a block diagram of a control apparatus of a second embodiment in accordance with the present invention. Terminals Q2, R2, SU1, SU2, SU3 and T2 in FIG. 7(*a*) are connected to terminals Q2, R2, SU1, SU2, SU3 and T2 in FIG. 7(*b*), respectively. In the second embodiment, the configuration and operation of the density control unit 130A in FIG. 7(*a*) are identical with those of the density control unit 130A in FIG. 6(*a*).

In a line width control unit 130C shown in FIG. 7(*b*), twenty-seven input variation vectors are operated in an input variation vector determining circuit 310A, and the input voltage $u_1$, the charge voltage $u_2$ and the developer bias voltage $u_3$ are output from an input vector renewal circuit 311A. Remaining components in FIG. 7(*b*) are identical with those of the line width control unit 130B in FIG. 6(*b*).

The developer bias voltage $u_3$ is varied on the basis of the detected value of the line width sensor 128A, and the line width is adjusted to meet the aimed value $Y_W$ of the line width. Additionally, a trend and an amount of variation in density which are caused by the variation of the developer bias voltage $u_3$ are predicted on the basis of qualitative models shown in Table 4. The qualitative model are predetermined in the qualitative model calculation circuit 303. And an input voltage $u_1$ and a charge voltage $u_2$ are output from the input vector renewal circuit 311A so as to eliminate the predicted density variation.

TABLE 4

| $[y_{3-d} - y_3]$ | $[\Delta Ui]$ |
|---|---|
| + | (−, +, −) |
| 0 | (0, 0, 0) |
| − | (+, −, +) |

In the successive density adjustment step by the density control unit 130A, the input voltage $u_1$ and the charge voltage $u_2$ output from the line width control unit 130C are superimposed on the output voltage $u_1$ and charge voltage $u_2$ output from the density control unit 130A, respectively, and the superimposed input voltage $u_1$ and the charge voltage $u_2$ are applied to the electrophotographic copier 105. Consequently, a density variation due to the line width adjustment which have been performed in the preceding line width adjustment step is decreased, and the detected value of density rapidly reaches the aimed value "$Y_d$" by reduced adjustment operations.

Figure 8:
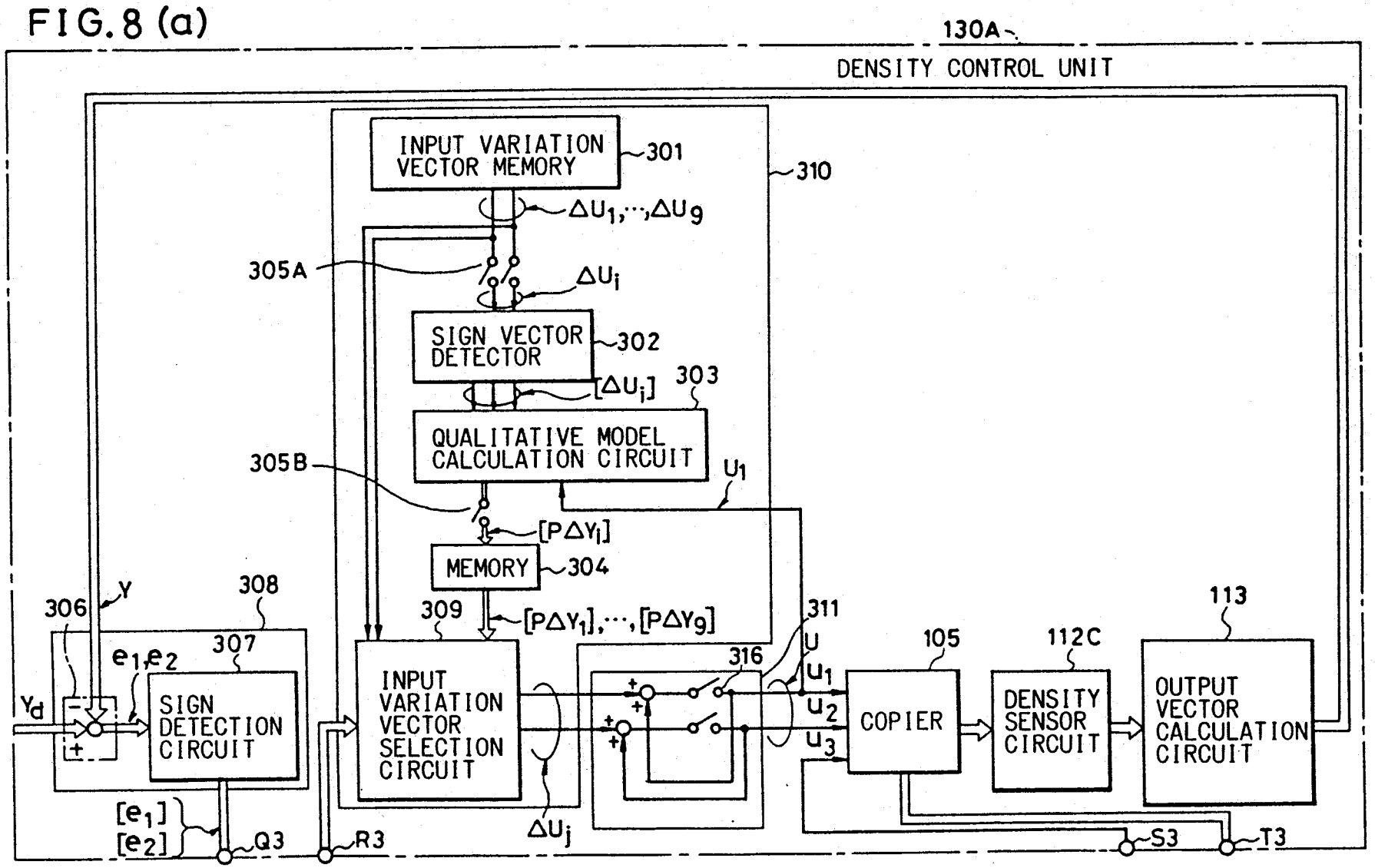
FIGS. 8(*a*) and 8(*b*) in combination show a block diagram of a control apparatus of a third embodiment in accordance with the present invention.
Figure 8B:
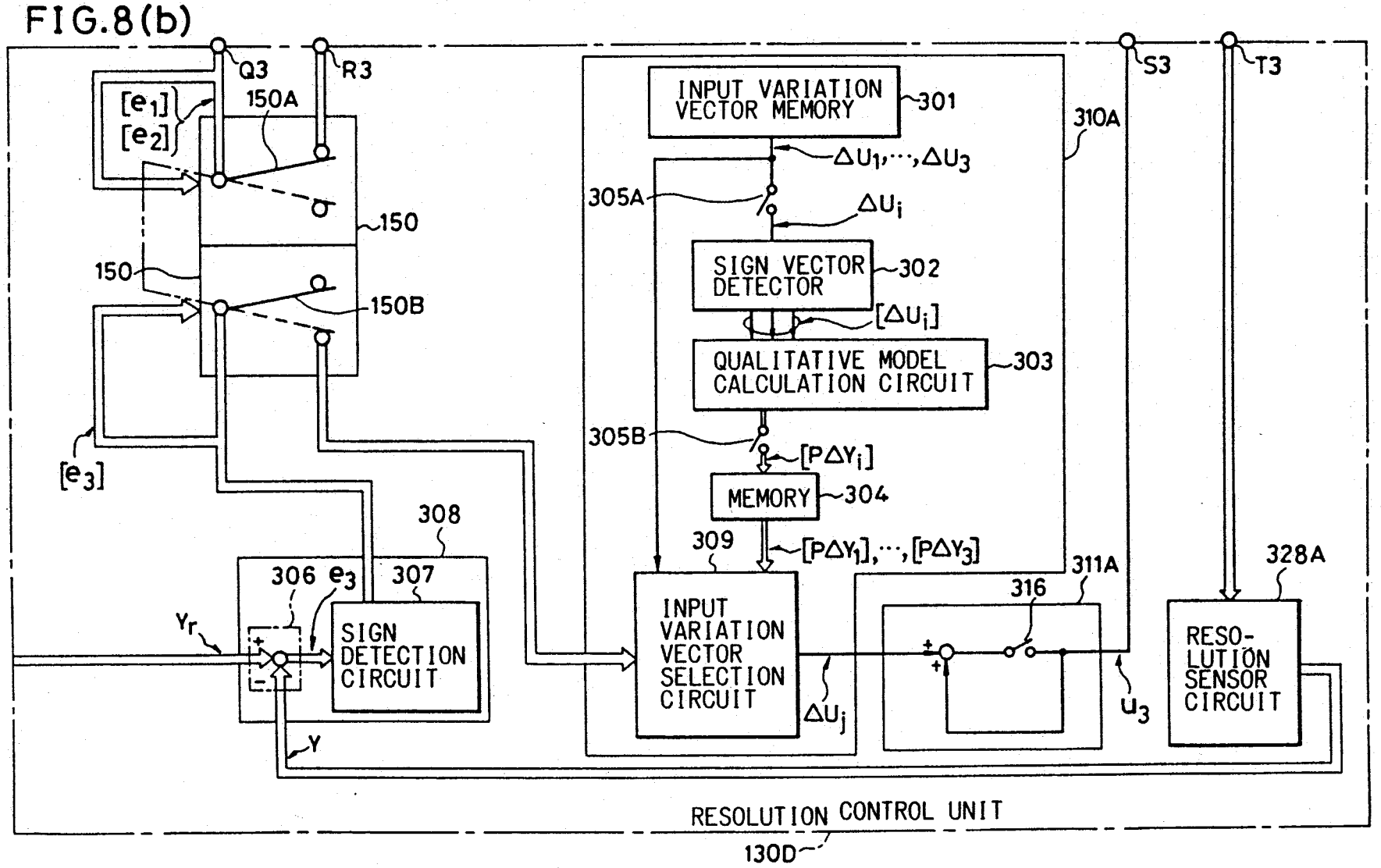

FIGS. 8(*a*) and 8(*b*) in combination show a block diagram of a control apparatus of a third embodiment in accordance with the present invention. Referring to FIGS. 8(*a*) and 8(*b*), terminals Q3, R3, S3 and T3 in FIG. 8(*a*) are connected to terminals Q3, R3, S3 and T3 in FIG. 8(*b*), respectively. A resolution sensor 328 is mounted as replacement for the line width sensor 128 in the first embodiment, and thereby a resolution of the electrophotographic copier is detected. The reference mark 124 which is used for the line width detection is usable for the resolution detection. A relatively small pitch of stripes is recommendable in order to detect with a higher accuracy.

First, in a similar manner to the first embodiment, the densities of the toner images 118 and 120 are detected by the density sensor 112, and the input voltage $u_1$ and the charge voltage $u_2$ are adjusted in the density control unit 130A so as to obtain optimum density characteristic.

Subsequently, a resolution is detected by the resolution sensor 328 on the basis of the toner image 126 of the reference mark 124, and the developer bias voltage $u_3$ is adjusted in the resolution control unit 130D in order to realize a maximum resolution. The configuration of the resolution control unit 130B is similar to the line width control unit 130B with the exception of the resolution sensor 328.

Figure 9:
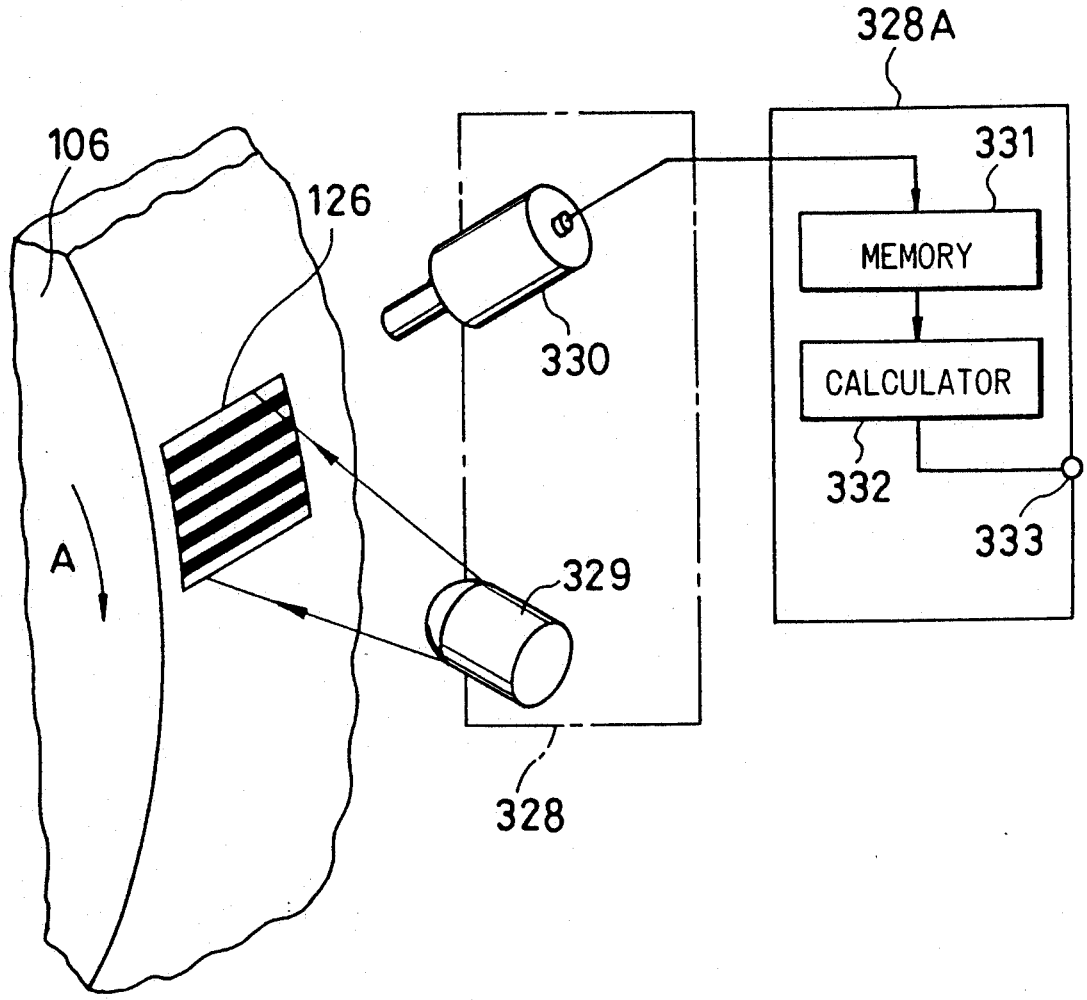
FIG. 9 is a configuration of a resolution sensor in the third embodiment.

Configuration of the resolution sensor 328 is elucidated in detail with reference to FIG. 9. The resolution sensor 328 comprises a light source 329 for illuminating the toner image 126 with a stable light and a light sensor device 330. The light sensor device 330 has an optical sensor element and an optical system which is similar to a microscope (both are not shown), and a reflected light from a microscopic area which is enlarged by the optical system is detected by the optical sensor element. The microscopic area is 10 micron–1 millimeter in diameter, and is predetermined in accordance with the pitch of the dark stripes of the toner image 126. For example, when the pitch of the dark stripes of the toner image 126 is 100 micron, the reflected light from each stripe of the toner image 126 can be separately detected by setting the microscopic area of about 40 micron in diameter.

In operation, the toner image 126 passes in front of the resolution sensor 328 by rotation of the drum 106 in the direction shown by an arrow A, and the dark stripes and light stripes of the toner image 126 is alternately detected by the light sensor device 330. The output of the light sensor device 330 is in proportion to the intensity of the reflected light from the dark stripe or the light stripe, and the data of the output is stored in a memory 331 in a resolution control circuit 328A. In the resolution control circuit 328A, the data of the output stored in the memory 331 is applied to a calculator 332, and a "contrast value", which is represented by a difference between the output of the dark stripe and the output of the light stripe, is derived thereby. The contrast value is output to a terminal 333 and is applied to the error sign detection circuit 308. The contrast value represents the resolution of the electrophotographic copier 105, and the higher the contrast value is, the higher the resolution is. In the third embodiment, the developer bias voltage $u_3$ is controlled so as to realize the most contrast value, and thereby the resolution is adjusted to the maximum value.

In operation of the third embodiment, first, the input voltage $u_1$ and the charge voltage $u_2$ are changed in the density control unit 130A, and the density is adjusted to the aimed value in a similar manner to the first embodiment. Subsequently, the resolution control unit 130C is activated by the switching operation of the switching unit 150, and the developer bias voltage $u_3$ is changed so as to obtain the maximum resolution. Both the operations in the density control unit 130A and the resolution control unit 130C are alternately repeated, and thereby improved reproduction in both the density characteristic and resolution is realizable.

In the embodiment of the electrophotographic copier in FIG. 1, the first, second and third reference marks 114, 116 and 124 are mounted on the manuscript holder 122 and is illuminated by the light source 102. And the respective optical images of these reference marks are focused on the drum 106 to produce the latent images. In other method of the electrophotography, the latent images can be produced on the drum 106 by a laser beam, which scans on the drum 106 on the basis of graphical data representing the first, second and third reference marks. Such method is usable to a laser printer system for example. The control apparatus in the first, second and third embodiments in the present invention are applicable to the above-mentioned laser printer system. In the above-mentioned application, the input voltage of a laser beam generating device is controlled as replacement for the control of the input voltage $u_1$ of the light source 102, and thereby a similar effect is realizable in the laser printer system.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. An electrophotographic apparatus comprising:

a first reference mark of a high density, a second reference mark of a low density and a third reference mark having a plurality of alternatingly arranged high density parts and low density parts, said reference marks being disposed adjacent to a manuscript to be copied, charging means for charging photoconductive substance of the electrophotographic apparatus with a predetermined voltage of static electricity, light emitting means for forming latent image of the static electricity of said first reference mark, second reference mark and third reference mark on said photoconductive substance by applying light emitted from said light emitting means activated by an input voltage, developer means for generating visible image of said latent image on said photoconductive substance by supplying toner which is biased by a predetermined developer bias voltage, density sensor means for detecting density of said visible image of said first and second reference marks formed on said photoconductive substance, line width sensor means for detecting a line width of one of said high density parts and said low density parts of said third reference mark, and control means for controlling said voltage of static electricity for charging said photoconductive substance, said input voltage which is applied to said light emitting means and said developer bias voltage on the basis of outputs of said density sensor and said line width sensor, said control means comprising:

a density control unit including:

input variation vector generating means for generating a plurality of input variation vectors for varying two selected from said voltage of static electricity, said input voltage and said developer bias voltage, qualitative model calculation means for outputting predictive sign data by applying calculation to said input variation vector on the basis of a predetermined qualitative model, error sign detection means for detecting the sign of a difference between an aimed density value and the detected value of said line width sensor means, an input variation vector selection circuit for selecting an input variation vector from said input variation vector generating means on the basis of both the output of said error sign detection means and predictive sign data, and input vector renewal means for adding voltages of said selected input variation vectors to said two selected from said voltage of static electricity, said input voltage and said developer bias voltage, a line width control unit including:

input variation vector generating means for generating a plurality of input variation vectors for varying remaining one of said voltage of static electricity, said input voltage and said developer bias voltage, qualitative model calculation means for outputting predictive sign data by applying calculation to said input variation vector on the basis of a predetermined qualitative model, error sign detection means for detecting the sign of a difference between an aimed line width value and the detected value of said line width sensor means, an input variation vector selection circuit for selecting an input variation vector from said input variation vector generating means on the basis of both the output of said error sign detection means and predictive sign data, input vector renewal means for adding a voltage of said selected input variation vector to said remaining one of said voltage of static electricity, said input voltage and said developer bias voltage, and switching means for alternately activating said density control unit and said line width control unit.

2. An electrophotographic apparatus comprising:

a first reference mark of a high density, a second reference mark of a low density and a third reference mark having a plurality of alternatingly arranged high density parts and low density parts, said reference marks being disposed adjacent to a manuscript to be copied, charging means for charging photoconductive substance of the electrophotographic apparatus with a predetermined voltage of static electricity, light emitting means for forming latent image of the static electricity of said first reference mark, second reference mark and third reference mark on said photoconductive substance by applying light emitted from said light emitting means activated by an input voltage, developer means for generating visible image of said latent image on said photoconductive substance by supplying toner which is biased by a predetermined developer bias voltages, density sensor means for detecting density of said visible image of said first and second reference marks formed on said photoconductive substance, line width sensor means for detecting a line width of one of said high density parts and said low density parts of said third reference mark, and control means for controlling said voltage of static electricity for charging said photoconductive substance, said input voltage which is applied to said light emitting means and said developer bias voltage on the basis of outputs of said density sensor and said line width sensor, said control means comprising:

a density control unit including:

input variation vector generating means for generating a plurality of input variation vectors for varying two selected from said voltage of static electricity, said input voltage and said developer bias voltage, qualitative model calculation means for outputting predictive sign data by applying calculation to said input variation vector on the basis of a predetermined qualitative model, error sign detection means for detecting the sign of a difference between an aimed line width value and the detected value of said line width sensor means, an input variation vector selection circuit for selecting input variation vectors from said input variation vector generating means on the basis of both the output of said error sign detection means and predictive sign data, and input vector renewal means for adding voltages of said selected input variation vectors to said two selected from said voltage of static electricity, said input voltage and said developer bias voltage, a line width control unit including:

input variation vector generating means for generating a plurality of input variation vectors for varying said voltage of static electricity, said input voltage and said developer bias voltage, qualitative model calculation means for outputting predictive sign data by applying calculation to said input variation vector on the basis of a predetermined qualitative model, error sign detection means for detecting the sign of a difference between an aimed line width value and the detected value of said line width sensor means, an input variation vector selection circuit for selecting an input variation vector from said input variation vector generating means on the basis of both the output of said error sign detection means and predictive sign data, input vector renewal means for adding voltages of said selected input variation vectors to said voltage of static electricity, said input voltage and said developer bias voltage, and switching means for alternately activating said density control unit and said line width control unit.

3. An electrophotographic apparatus comprising:

a first reference mark of a high density, a second reference mark of a low density and a third reference mark having a plurality of alternatingly arranged high density parts and low density parts, said reference marks being disposed adjacent to a manuscript to be copied, charging means for charging photoconductive substance of the electrophotographic apparatus with a predetermined voltage of static electricity, light emitting means for forming latent image of the static electricity of said first reference mark, second reference mark and third reference mark on said photoconductive substance by applying light emitted from said light emitting means activated by an input voltage, developer means for generating visible image of said latent image on said photoconductive substance by supplying toner which is biased by a predetermined developer bias voltages, density sensor means for detecting density of said visible image of said first and second reference marks formed on said photoconductive substance, resolution sensor means for detecting a resolution of said striped high density parts and low density parts of said third reference mark, and control means for controlling said voltage of static electricity for charging said photoconductive substance, said input voltage which is applied to said light emitting means and said developer bias voltage on the basis of outputs of said density sensor and said resolution sensor, said control means comprising:

a density control unit including:

input variation vector generating means for generating a plurality of input variation vectors for varying two selected from said voltage of static electricity, said input voltage and said developer bias voltage, qualitative model calculation means for outputting predictive sign data by applying calculation to said input variation vector on the basis of a predetermined qualitative model, error sign detection means for detecting the sign of a difference between an aimed density value and the detected value of said density sensor means, an input variation vector selection circuit for selecting an input variation vector from said input variation vector generating means on the basis of both the output of said error sign detection means and predictive sign data, and input vector renewal means for adding voltages of said selected input variation vector to said two selected from said voltage of static electricity, said input voltage and said developer bias voltage, a resolution control unit including:

input variation vector generating means for generating a plurality of input variation vectors for varying remaining one of said voltage of static electricity, said input voltage and said developer bias voltage, qualitative model calculation means for outputting predictive sign data by applying calculating to said input variation vector on the bias of a predetermined qualitative model, error sign detection means for detecting the sign of a difference between an aimed resolution value and the detected value of said resolution sensor means, an input variation vector selection circuit for selecting an input variation vector from said input variation vector generating means on the basis of both the output of said error sign detection means and predictive sign data, input vector renewal means for adding a voltage of said selected input variation vector to said remaining one of said voltage of static electricity, said input voltage and said developer bias voltage, and switching means for alternately activating said density control unit and said resolution control unit.

4. An electrophotographic apparatus in accordance with claim 1, 2 or 3, wherein said third reference mark is a pattern of alternating dark and light stripes, and said line width is detected on the basis of an average density of said pattern.

5. An electrophotographic apparatus in accordance with claim 1 or 2, wherein said third reference mark is a pattern of polka dots, and said line width is detected on the basis of an average density of said pattern.

6. An electrophotographic apparatus in accordance with claim 1, 2 or 3, wherein said density sensor is located adjacent to transfer belt means for transferring said visible images and detects transferred visible images of said first and second reference marks on said transfer belt means.

7. An electrophotographic apparatus in accordance with claim 1 or 2, wherein said line width sensor is located adjacent to transfer belt means for transferring said visible image and detects transferred visible image of said third reference mark on said transfer belt means.

8. An electrophotographic apparatus in accordance with claim 3, wherein said resolution sensor is located adjacent to transfer belt means for transferring said visible image and detects transferred visible image of said third reference mark on said transfer belt means.

9. An electrophotographic apparatus in accordance with claim 1, 2 or 3, wherein said first, second and third reference marks are placed outward from the area covered by a manuscript on a manuscript holder of the electrophotographic apparatus.

10. An electrophotographic apparatus in accordance with claim 1, 2 or 3, wherein said input voltage and said voltage of static electricity are changed to adjust the density of said visible image and said developer bias voltage is changed to adjust said line width.

* * * * *